US011256187B2

(12) United States Patent
Ogaki et al.

(10) Patent No.: US 11,256,187 B2
(45) Date of Patent: Feb. 22, 2022

(54) PROCESS CARTRIDGE AND ELECTROPHOTOGRAPHIC APPARATUS

(71) Applicant: CANON KABUSHIKI KAISHA, Tokyo (JP)

(72) Inventors: Harunobu Ogaki, Oyama (JP); Kazunori Noguchi, Suntou-gun (JP); Takeshi Murakami, Yokohama (JP); Takashi Kenmoku, Mishima (JP); Yuzo Seino, Gotemba (JP); Kenta Kamikura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/934,159

(22) Filed: Jul. 21, 2020

(65) Prior Publication Data

US 2021/0026261 A1 Jan. 28, 2021

(30) Foreign Application Priority Data

Jul. 25, 2019 (JP) ..... JP2019-137131
Jun. 30, 2020 (JP) ..... JP2020-113418

(51) Int. Cl.
*G03G 9/08* (2006.01)
*G03G 5/147* (2006.01)
(Continued)

(52) U.S. Cl.
CPC ..... *G03G 5/14786* (2013.01); *G03G 9/09708* (2013.01); *G03G 15/087* (2013.01)

(58) Field of Classification Search
CPC ..... G03G 5/14786; G03G 9/09708; G03G 15/087
(Continued)

(56) References Cited

U.S. PATENT DOCUMENTS 6,777,153 B2 8/2004 Yano et al.
6,808,907 B2 10/2004 Honma et al.
(Continued)

FOREIGN PATENT DOCUMENTS

JP 2001-209207 8/2001
JP 2002-287412 10/2002
(Continued)

OTHER PUBLICATIONS

U.S. Appl. No. 16/935,254, Takashi Kenmoku, filed Jul. 22, 2020.
(Continued)

*Primary Examiner* — Mark A Chapman
(74) *Attorney, Agent, or Firm* — Venable LLP

(57) ABSTRACT

Provided are a process cartridge and an electrophotographic apparatus each of which is reduced in fogging for reducing a toner consumption. Specifically, provided is a process cartridge, which is removably mounted onto a main body of an electrophotographic apparatus, the process cartridge including: a developing unit containing a toner; and an electrophotographic photosensitive member, wherein the toner is a toner including a toner particle, and has a polyvalent acid metal salt on at least part of a surface of the toner particle, wherein the polyvalent acid metal salt includes at least one kind of metal element selected from metal elements belonging to from Group 3 to Group 13, and wherein a surface layer of the electrophotographic photosensitive member contains a resin including a siloxane segment.

10 Claims, 1 Drawing Sheet

(51) Int. Cl.
*G03G 9/097* (2006.01)
*G03G 15/08* (2006.01)

(58) Field of Classification Search
USPC ..... 430/66, 108.3
See application file for complete search history.

(56) References Cited

U.S. PATENT DOCUMENTS

| | | | |
|---|---|---|---|
| 6,908,721 | B2 | 6/2005 | Kenmoku et al. |
| 6,911,520 | B2 | 6/2005 | Fukui et al. |
| 7,045,321 | B2 | 5/2006 | Imamura et al. |
| 7,393,912 | B2 | 7/2008 | Mihara et al. |
| 7,399,568 | B2 | 7/2008 | Fukui et al. |
| 7,408,017 | B2 | 8/2008 | Imamura et al. |
| 7,452,960 | B2 | 11/2008 | Yano et al. |
| 7,510,813 | B2 | 3/2009 | Yano et al. |
| 7,638,194 | B2 | 12/2009 | Fukui et al. |
| 7,638,590 | B2 | 12/2009 | Fukui et al. |
| 7,682,765 | B2 | 3/2010 | Sugawa et al. |
| 7,795,363 | B2 | 9/2010 | Fukui et al. |
| 7,901,855 | B2 | 3/2011 | Ogaki et al. |
| 7,935,771 | B2 | 5/2011 | Fukui et al. |
| 8,067,136 | B2 | 11/2011 | Yano et al. |
| 8,093,342 | B2 | 1/2012 | Minami et al. |
| 8,110,329 | B2 | 2/2012 | Tominaga et al. |
| 8,178,271 | B2 | 5/2012 | Fukui et al. |
| 8,383,312 | B2 | 2/2013 | Fujimoto et al. |
| 8,574,801 | B2 | 11/2013 | Itabashi et al. |
| 8,609,312 | B2 | 12/2013 | Itabashi et al. |
| 8,828,633 | B2 | 9/2014 | Itabashi et al. |
| 8,828,639 | B2 | 9/2014 | Kamikura et al. |
| 9,029,056 | B2 | 5/2015 | Kenmoku et al. |
| 9,098,002 | B2 | 8/2015 | Kenmoku et al. |
| 9,098,003 | B2 | 8/2015 | Masumoto et al. |
| 9,423,714 | B2 | 8/2016 | Kenmoku et al. |
| 9,684,277 | B2 | 6/2017 | Yamamoto et al. |
| 9,880,478 | B2 | 1/2018 | Shimano et al. |
| 9,952,523 | B2 | 4/2018 | Shimano et al. |
| 10,114,303 | B2 | 10/2018 | Katsura et al. |
| 10,303,074 | B2 | 5/2019 | Yamawaki et al. |
| 10,310,396 | B2 | 6/2019 | Kamikura et al. |
| 10,338,487 | B2 | 7/2019 | Kamikura et al. |
| 10,345,726 | B2 | 7/2019 | Nakamura et al. |
| 10,353,308 | B2 | 7/2019 | Hatakeyama et al. |
| 10,401,750 | B2 | 9/2019 | Nakamura et al. |
| 10,429,757 | B2 | 10/2019 | Yoshida et al. |
| 10,503,090 | B2 | 12/2019 | Tominaga et al. |
| 10,539,893 | B2 | 1/2020 | Tanaka et al. |
| 10,539,899 | B2 | 1/2020 | Nakamura |
| 10,545,422 | B2 | 1/2020 | Yamawaki |
| 10,551,758 | B2 | 2/2020 | Tanaka |
| 10,635,010 | B2 | 4/2020 | Kamikura |
| 10,732,530 | B2 | 8/2020 | Matsui |
| 10,747,136 | B2 | 8/2020 | Kenmoku |
| 2005/0260514 | A1 | 11/2005 | Mihara |
| 2006/0029870 | A1 | 2/2006 | Nukada et al. |
| 2006/0194071 | A1 | 8/2006 | Yano |
| 2007/0275317 | A1 | 11/2007 | Fujimoto |
| 2013/0065174 | A1 | 3/2013 | Itabashi |
| 2019/0271926 | A1 | 9/2019 | Kamikura |
| 2019/0384197 | A1 | 12/2019 | Aoki |
| 2019/0384200 | A1 | 12/2019 | Kamikura |
| 2020/0356019 | A1 | 11/2020 | Matsui |

FOREIGN PATENT DOCUMENTS

| | | |
|---|---|---|
| JP | 2005-195769 | 7/2005 |
| JP | 2006-072293 | 3/2006 |
| JP | 2007-079555 | 3/2007 |
| JP | 2007-199688 | 8/2007 |
| JP | 2016-105165 | 6/2016 |

OTHER PUBLICATIONS

U.S. Appl. No. 16/935,259, Akihiko Uchiyama, filed Jul. 22, 2020.
U.S. Appl. No. 16/935,263, Kenta Kamikura, filed Jul. 22, 2020.
U.S. Appl. No. 16/935,268, Noritaka Toyoizumi, filed Jul. 22, 2020.
U.S. Appl. No. 16/935,271, Kenta Kamikura, filed Jul. 22, 2020.

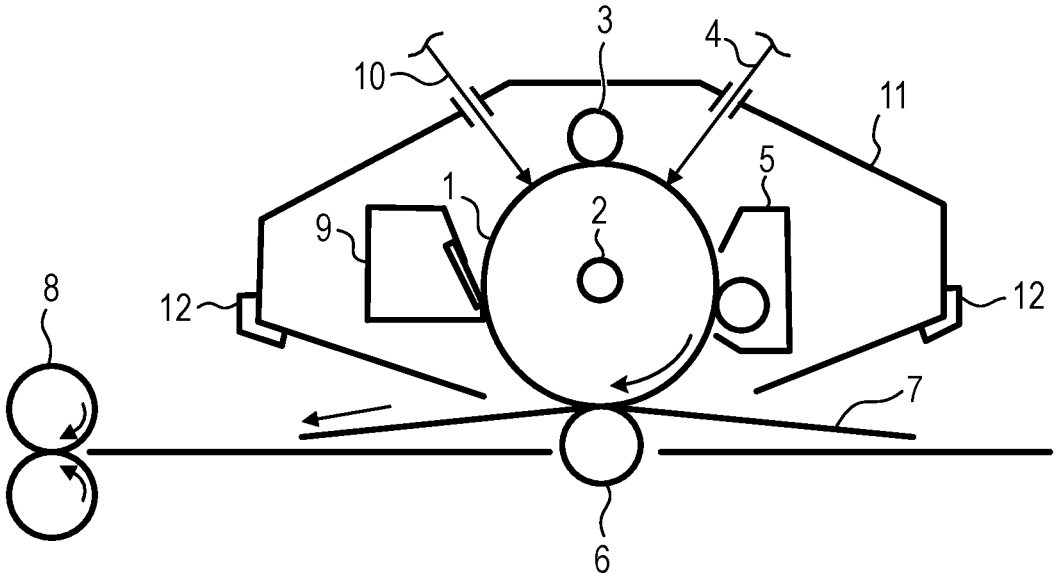
3
4
10
11
5
1
2
9
8
12
12
7
6

PROCESS CARTRIDGE AND ELECTROPHOTOGRAPHIC APPARATUS

BACKGROUND OF THE INVENTION

Field of the Invention

The present invention relates to a process cartridge and an electrophotographic apparatus.

Description of the Related Art

In an electrophotographic process, downsizing of an electrophotographic apparatus and an increase in number of sheets on which images can be printed have been desired in recent years. In correspondence with the foregoing, a further reduction in toner consumption has been required. To reduce the toner consumption, the reduction of fogging in which a toner is developed in a non-image portion has been required.

In Japanese Patent Application Laid-Open No. 2001-209207, there is a disclosure of a toner improved in developability and durability by causing inorganic fine particles each including a phosphoric acid-based anion and a zirconium ion to adhere to its toner surface.

In Japanese Patent Application Laid-Open No. 2007-199688, there is a disclosure of a technology of incorporating a siloxane-modified resin including a siloxane structure in its molecular chain into the surface layer of an electrophotographic photosensitive member to be brought into contact with various members.

According to an investigation by the inventors of the present invention, a process cartridge described in each of Japanese Patent Application Laid-Open No. 2001-209207 and Japanese Patent Application Laid-Open No. 2007-199688 has been improved in terms of the reduction of fogging that is visually observed on an image. However, the investigation has revealed that a further fogging reduction is desired in terms of a reduction in toner consumption.

Further features of the present invention will become apparent from the following description of exemplary embodiments with reference to the attached drawing.

SUMMARY OF THE INVENTION

Therefore, an object of the present invention is to provide a process cartridge and an electrophotographic apparatus each of which is reduced in fogging for reducing a toner consumption.

The object is achieved by the present invention described below.

That is, according to at least one embodiment of the present invention, there is provided a process cartridge including: a developing unit containing a toner; and an electrophotographic photosensitive member, wherein the toner is a toner including a toner particle, and has a polyvalent acid metal salt on at least part of a surface of the toner particle, wherein the polyvalent acid metal salt includes at least one kind of metal element selected from metal elements belonging to from Group 3 to Group 13, and wherein a surface layer of the electrophotographic photosensitive member contains a resin including a siloxane segment.

In addition, according to at least one embodiment of the present invention, there is provided an electrophotographic apparatus including the process cartridge.

BRIEF DESCRIPTION OF THE DRAWINGS

FIGURE is a view for illustrating an example of a schematic configuration of an electrophotographic apparatus including a process cartridge including an electrophotographic photosensitive member.

DESCRIPTION OF THE EMBODIMENTS

The present invention is described in detail below by way of exemplary embodiments.

A process cartridge and an electrophotographic apparatus according to at least one embodiment of the present invention are each characterized by including, for solving the above-mentioned problem, a configuration in which a toner having a polyvalent acid metal salt on at least part of the surface of a toner particle and an electrophotographic photosensitive member containing, in its surface layer, a resin including a siloxane segment are combined.

The inventors of the present invention have assumed the mechanism via which fogging is reduced by combining the toner and the electrophotographic photosensitive member satisfying such features to be as described below.

In an electrophotographic process, image formation is generally performed by a method including: forming a toner image on the electrophotographic photosensitive member; and transferring the image onto an intermediate transfer body or paper.

The toner having the polyvalent acid metal salt on at least part of the surface of the toner particle is negatively charged by the polarization of the polyvalent acid metal salt with ease, and is hence excellent in chargeability. In addition, the polyvalent acid metal salt has a moderate resistance value, and hence charge easily moves. Negative charge is supplied from the resin including the siloxane segment, which is incorporated into the surface layer of the electrophotographic photosensitive member, to the polyvalent acid metal salt on the surface of the toner particle. This is probably because the polyvalent acid metal salt on the surface of the toner particle and the resin including the siloxane segment in the surface layer of the electrophotographic photosensitive member are brought into contact with each other to cause charge transfer based on a triboelectric series between constituent materials. The inventors have assumed that as a result of the foregoing, at the time of the formation of the toner image on the electrophotographic photosensitive member, negative charge is supplied from the electrophotographic photosensitive member to the toner to improve the charging uniformity of the toner, thereby reducing the fogging.

[Toner]

The toner in at least one embodiment of the present invention is a toner including a toner particle, and is characterized by having the polyvalent acid metal salt on at least part of the surface of the toner particle.

The polyvalent acid metal salt includes a combination of a polyvalent acid and a metal element.

The polyvalent acid may be any acid as long as the polyvalent acid is divalent or higher valent. Specific examples thereof include the following acids: an inorganic acid, such as phosphoric acid, carbonic acid, or sulfuric acid; and an organic acid, such as a dicarboxylic acid or a tricarboxylic acid. Specific examples of the dicarboxylic acid include oxalic acid, malonic acid, succinic acid, glutaric acid, adipic acid, fumaric acid, maleic acid, pimelic acid, suberic acid, azelaic acid, sebacic acid, phthalic acid, isophthalic acid, and terephthalic acid. Examples of the tricarboxylic acid include citric acid, aconitic acid, and trimellitic acid.

The polyvalent acid metal salt preferably contains at least one acid selected from phosphoric acid, carbonic acid, and sulfuric acid out of the polyvalent acids because the metal element and the polyvalent acid strongly react with each other, and hence the polyvalent acid metal salt hardly absorbs moisture. The polyvalent acid metal salt more preferably contains phosphoric acid.

The polyvalent acid metal salt preferably contains, as a metal element for forming the polyvalent acid metal salt, at least one kind of metal element selected from metal elements belonging to from Group 3 to Group 13. A salt including a metal element belonging to any one of Group 3 to Group 13 and a polyvalent acid has low moisture absorptivity, and hence can stably provide a fogging-reducing effect even in a high-humidity environment.

Specific examples of the metal element include titanium, zirconium, aluminum, zinc, indium, hafnium, iron, copper, silver, and the like. Of those, a metal capable of having a valency of 3 or more is preferred. More specifically, of those, titanium, zirconium, and aluminum are more preferred, and titanium is still more preferred.

Preferred examples of the polyvalent acid metal salt include a phosphoric acid metal salt, a sulfuric acid metal salt, a carbonic acid metal salt, and an oxalic acid metal salt. Examples of the phosphoric acid metal salt include a titanium phosphate compound, a zirconium phosphate compound, an aluminum phosphate compound, and a copper phosphate compound. Examples of the sulfuric acid metal salt include a titanium sulfate compound, a zirconium sulfate compound, and an aluminum sulfate compound. Examples of the carbonic acid metal salt include a titanium carbonate compound, a zirconium carbonate compound, and an aluminum carbonate compound. An example of the oxalic acid metal salt is a titanium oxalate compound. Of those, a phosphoric acid metal salt is preferred because a phosphate ion forms a crosslink between metal atoms to impart high strength to the salt, and because the salt has an ionic bond in a molecule thereof, and is hence excellent in charge rising performance. A titanium phosphate compound is more preferred.

A method of producing the polyvalent acid metal salt is not particularly limited, and a conventionally known method may be used. A method including causing a metal compound containing a metal element and a polyvalent acid ion to react with each other in an aqueous medium to provide the polyvalent acid metal salt is preferred. A conventionally known metal compound may be used without any particular limitation as long as the metal compound provides the polyvalent acid metal salt through a reaction with the polyvalent acid ion, and examples thereof include a metal chelate and a metal alkoxide.

Examples of the metal chelate include titanium lactate, titanium tetraacetylacetonate, a titanium lactate ammonium salt, titanium triethanolaminate, zirconium lactate, a zirconium lactate ammonium salt, aluminum lactate, aluminum trisacetylacetonate, and copper lactate. Examples of the metal alkoxide include titanium tetraisopropoxide, titanium ethoxide, zirconium tetraisopropoxide, and aluminum trisisopropoxide. Of those, a metal chelate is preferred because of the ease of controlling the reaction and a quantitative reaction with the polyvalent acid ion. In addition, a lactic acid chelate, such as titanium lactate or zirconium lactate, is more preferred from the viewpoint of solubility into the aqueous medium.

An ion of the above-mentioned polyvalent acid may be used as the polyvalent acid ion when the polyvalent acid metal salt is obtained by the above-mentioned production method. With regard to the form of the polyvalent acid ion when added to the aqueous medium, the polyvalent acid itself may be added, or a water-soluble polyvalent acid metal salt may be added to the aqueous medium and dissociated in the aqueous medium.

The number-average particle diameter of the polyvalent acid metal salt is preferably 1 nm or more and 400 nm or less, more preferably 1 nm or more and 200 nm or less, still more preferably 1 nm or more and 60 nm or less.

When the number-average particle diameter of the polyvalent acid metal salt is set within the ranges, member contamination due to the migration of the polyvalent acid metal salt from the toner to the surface of the photosensitive member or any other member can be suppressed. Thus, the negative chargeability of the surface of the toner and the positive chargeability of the surface of the photosensitive member are easily maintained. Accordingly, the fogging-reducing effect is more easily obtained.

Approaches to adjusting the number-average particle diameter of the polyvalent acid metal salt within the ranges are, for example, the addition amounts of the polyvalent acid and the compound containing the metal element, which are raw materials for the particles of the polyvalent acid metal salt, a pH at the time of the reaction, and a temperature at the time of the reaction.

When the polyvalent acid and the compound containing the metal element are caused to react with each other in a dispersion liquid of a toner base particle, and the resultant reaction product is caused to adhere to the surface of the toner base particle to provide the toner particle, an organosilicon compound represented by the formula (T-1) is preferably used in combination.

When the organosilicon compound is used in combination, the resultant reaction product more strongly sticks to the toner particle, and the surface of the particle is hydrophobized. Thus, the environmental stability of the toner is further improved.

Specifically, the organosilicon compound represented by the formula (T-1) is hydrolyzed in advance, or is hydrolyzed in the dispersion liquid of the toner base particle. After that, the resultant hydrolysate of the organosilicon compound is condensed to provide a condensate. The condensate migrates to the surface of the toner particle. The condensate has viscosity, and hence can bring the product of the reaction between the polyvalent acid and the compound containing the metal element into close contact with the surface of the toner particle to more strongly stick the reaction product to the toner particle. The condensate also migrates to the surface of the reaction product to hydrophobize the reaction product, and hence the environmental stability can be further improved.

$$R_{a(n)}—Si—R_{b(4-n)} \quad \text{(T-1)}$$

In the formula (T-1), $R_a$ represents a halogen atom, a hydroxy group, or an alkoxy group, $R_b$ represents an alkyl group, an alkenyl group, an aryl group, an acyl group, or a methacryloxyalkyl group, and "n" represents an integer of from 2 to 4; provided that when a plurality of $R_a$s or a plurality of $R_b$s are present, the plurality of $R_a$s or the plurality of $R_b$s may be identical to or different from each other.

A known organosilicon compound may be used as the organosilicon compound represented by the formula (T-1) without any particular limitation. Specific examples thereof include a bifunctional silane compound in which "n" represents 2, a trifunctional silane compound in which "n" represents 3, and a tetrafunctional silane compound in which "n" represents 4 described below.

Examples of the bifunctional silane compound include dimethyldimethoxysilane and dimethyldiethoxysilane.

Examples of the trifunctional silane compound include a trifunctional silane compound having an alkyl group as $R_b$, a trifunctional silane compound having an alkenyl group as $R_b$, a trifunctional silane compound having an aryl group as $R_b$, and a trifunctional silane compound having a methacryloxyalkyl group as $R_b$. Examples of the trifunctional silane compound having an alkyl group as $R_b$ include methyltrimethoxysilane, methyltriethoxysilane, methyldiethoxymethoxysilane, methylethoxydimethoxysilane, ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltrimethoxysilane, octyltriethoxysilane, decyltrimethoxysilane, and decyltriethoxysilane. Examples of the trifunctional silane compound having an alkenyl group as $R_b$ include vinyltrimethoxysilane, vinyltriethoxysilane, allyltrimethoxysilane, and allyltriethoxysilane. Examples of the trifunctional silane compound having an aryl group as $R_b$ include phenyltrimethoxysilane and phenyltriethoxysilane. Examples of the trifunctional silane compound having a methacryloxyalkyl group as $R_b$ include γ-methacryloxypropyltrimethoxysilane, γ-methacryloxypropyltriethoxysilane, γ-methacryloxypropyldiethoxymethoxysilane, and γ-methacryloxypropylethoxydimethoxysilane.

Examples of the tetrafunctional silane compound include tetramethoxysilane, tetraethoxysilane, tetrapropoxysilane, and tetrabutoxysilane.

The content of the condensate of at least one organosilicon compound selected from the group consisting of the organosilicon compounds each represented by the formula (T-1) in the toner particle is preferably 0.1 mass % or more and 20.0 mass % or less, more preferably 0.5 mass % or more and 15.0 mass % or less.

A method of producing the toner base particle is not particularly limited, and for example, a known suspension polymerization method, a known dissolution suspension method, a known emulsion aggregation method, and a known pulverization method may each be used.

In the case where the product of the reaction between the polyvalent acid and the compound containing the metal element is caused to be present on the surface of the toner particle, when the toner base particle is produced in an aqueous medium, the toner base particle may be used as it is as the dispersion liquid of the toner base particle. In addition, the toner base particle may be washed, filtered, and dried, and then dispersed in the aqueous medium again to provide the dispersion liquid of the toner base particle.

Meanwhile, when the toner base particle is produced by a dry process, the toner base particle may be dispersed in the aqueous medium by a known method to provide the dispersion liquid of the toner base particle. To disperse the toner base particle in the aqueous medium, the aqueous medium preferably contains a dispersion stabilizer.

An example of the production of the toner base particle through use of a suspension polymerization method is specifically described below.

First, a polymerizable monomer capable of producing a binder resin, and as required, various additives are mixed, and the materials are dissolved or dispersed with a dispersing machine to prepare a polymerizable monomer composition.

Examples of the various additives include a colorant, a wax, a charge control agent, a polymerization initiator, and a chain transfer agent.

The dispersing machine is, for example, a homogenizer, a ball mill, a colloid mill, or an ultrasonic dispersing machine.

Next, the polymerizable monomer composition is loaded into an aqueous medium containing poorly water-soluble inorganic particles, and the liquid droplets of the polymerizable monomer composition are prepared by using a high-speed dispersing machine, such as a high-speed stirring machine or an ultrasonic dispersing machine (granulation step).

After that, the polymerizable monomer in each of the liquid droplets is polymerized to provide the toner base particle (polymerization step).

The polymerization initiator may be mixed at the time of the preparation of the polymerizable monomer composition, or may be mixed in the polymerizable monomer composition immediately before the formation of the liquid droplets in the aqueous medium.

In addition, during the granulation of the liquid droplets or after the completion of the granulation, that is, immediately before the initiation of the polymerization reaction, the initiator may be added under a state of being dissolved in the polymerizable monomer or any other solvent as required.

After the polymerizable monomer has been polymerized to provide resin particles, desolvation treatment is desirably performed as required to provide the dispersion liquid of the toner base particle.

Examples of the binder resin include the following resins or polymers.

Specific examples of the resin include a vinyl-based resin, a polyester resin, a polyamide resin, a furan resin, an epoxy resin, a xylene resin, and a silicone resin. Of those, a vinyl-based resin is preferred. Examples of the vinyl-based resin include polymers of the following monomers or copolymers thereof: styrene-based monomers, such as styrene and α-methylstyrene; unsaturated carboxylic acid esters, such as methyl acrylate, butyl acrylate, methyl methacrylate, 2-hydroxyethyl methacrylate, t-butyl methacrylate, and 2-ethylhexyl methacrylate; unsaturated carboxylic acids, such as acrylic acid and methacrylic acid; unsaturated dicarboxylic acids, such as maleic acid; unsaturated dicarboxylic acid anhydrides, such as maleic acid anhydride; nitrile-based vinyl monomers, such as acrylonitrile; halogen-containing vinyl monomers, such as vinyl chloride; and nitro-based vinyl monomers, such as nitrostyrene. Of those, a copolymer using a styrene-based monomer and an unsaturated carboxylic acid ester as monomers is preferred.

A black pigment, a yellow pigment, a magenta pigment, and a cyan pigment described below are each used as the colorant.

An example of the black pigment is carbon black

Examples of the yellow pigment include a monoazo compound, a disazo compound, a condensed azo compound, an isoindolinone compound, an isoindoline compound, a benzimidazolone compound, an anthraquinone compound, an azo metal complex, a methine compound, and an arylamide compound. A specific example thereof is C.I. Pigment Yellow 74, 93, 95, 109, 111, 128, 155, 174, 180, or 185.

Examples of the magenta pigment include a monoazo compound, a condensed azo compound, a diketopyrrolopyrrole compound, an anthraquinone compound, a quinacridone compound, a basic dye lake compound, a naphthol compound, a benzimidazolone compound, a thioindigo compound, and a perylene compound. Specific examples thereof include: C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, or 269; and C.I. Pigment Violet 19.

Examples of the cyan pigment include: a copper phthalocyanine compound and a derivative thereof; an anthraquinone compound; and a basic dye lake compound. A specific example thereof is C.I. Pigment Blue 1, 7, 15, 15:1, 15:2, 15:3, 15:4, 60, 62, or 66.

In addition, various dyes conventionally known as colorants may be used in combination with any such pigment.

The content of the colorant is preferably 1.0 part by mass or more and 20.0 parts by mass or less with respect to 100 parts by mass of the binder resin.

A magnetic material may be incorporated into the toner to turn the toner into a magnetic toner. In this case, the magnetic material may also serve as a colorant.

Examples of the magnetic material include: an iron oxide typified by magnetite, hematite, or ferrite; a metal typified by iron, cobalt, or nickel, or an alloy formed of any such metal and a metal such as aluminum, cobalt, copper, lead, magnesium, tin, zinc, antimony, beryllium, bismuth, cadmium, calcium, manganese, selenium, titanium, tungsten, or vanadium; and mixtures thereof.

Examples of the wax include: an ester of a monohydric alcohol and an aliphatic monocarboxylic acid, or an ester of a monovalent carboxylic acid and an aliphatic monoalcohol, such as behenyl behenate, stearyl stearate, and palmityl palmitate; an ester of a dihydric alcohol and an aliphatic monocarboxylic acid, or an ester of a divalent carboxylic acid and an aliphatic monoalcohol, such as dibehenyl sebacate and hexanediol dibehenate; an ester of a trhydric alcohol and an aliphatic monocarboxylic acid, or an ester of a trivalent carboxylic acid and an aliphatic monoalcohol, such as glycerin tribehenate; an ester of a tetrahydric alcohol and an aliphatic monocarboxylic acid, or an ester of a tetravalent carboxylic acid and an aliphatic monoalcohol, such as pentaerythritol tetrastearate and pentaerythritol tetrapalmitate; an ester of a hexahydric alcohol and an aliphatic monocarboxylic acid, or an ester of a hexavalent carboxylic acid and an aliphatic monoalcohol, such as dipentaerythritol hexastearate and dipentaerythritol hexapalmitate; an ester of a polyhydric alcohol and an aliphatic monocarboxylic acid, or an ester of a polyvalent carboxylic acid and an aliphatic monoalcohol, such as polyglycerin behenate; natural ester waxes, such as carnauba wax and rice wax; petroleum-based waxes and derivatives thereof, such as paraffin wax, microcrystalline wax, and petrolatum; hydrocarbon waxes and derivatives thereof obtained by a Fischer-Tropsch process; polyolefin waxes and derivatives thereof, such as polyethylene wax and polypropylene wax; higher aliphatic alcohols; fatty acids, such as stearic acid and palmitic acid; and acid amide waxes.

The content of the wax is preferably 0.5 part by mass or more and 20.0 parts by mass or less with respect to 100 parts by mass of the binder resin.

Various organic particles or inorganic particles may be externally added to the toner particle to the extent that the characteristics or effects of the toner are not impaired. Examples of the organic particles or the inorganic particles include: fluidity-imparting agents, such as silica, alumina, titanium oxide, carbon black, and carbon fluoride; abrasives, such as a metal oxide (strontium titanate, cerium oxide, alumina, magnesium oxide, or chromium oxide), a nitride (silicon nitride), a carbide (silicon carbide), and a metal salt (calcium sulfate, barium sulfate, or calcium carbonate); lubricants, such as fluorine-based resin particles (vinylidene fluoride or polytetrafluoroethylene) and a fatty acid metal salt (zinc stearate or calcium stearate); and charge-controllable particles, such as a metal oxide (tin oxide, titanium oxide, zinc oxide, silica, or alumina) and carbon black.

The organic particles or/and the inorganic particles may be subjected to hydrophobic treatment. Examples of a treatment agent for the hydrophobic treatment of the organic particles and/or the inorganic particles include an unmodified silicone varnish, various modified silicone varnishes, an unmodified silicone oil, various modified silicone oils, a silane compound, a silane coupling agent, and other organosilicon compounds and organotitanium compounds. Those treatment agents may be used alone or in combination thereof.

<Structure of Section of Toner Particle>

A preferred mode when a section of the toner particle for forming the toner in at least one embodiment of the present invention is observed with a transmission electron microscope is described below.

When a section of the toner particle observed with a transmission electron microscope and the energy-dispersive X-ray spectroscopy (EDX) mapping image of constituent elements for the section of the toner particle obtained through analysis involving using EDX are compared to each other, it can be confirmed that an organosilicon polymer forms a protruded portion at a position corresponding to the surface of the toner base particle. The toner particle for forming the toner according to at least one embodiment of the present invention is preferably such that when the height of the protruded portion is represented by a protrusion height H, the protrusion height H is 30 nm or more and 300 nm or less. A method of calculating the protrusion height H is described later.

The toner according to at least one embodiment of the present invention is preferably such that when the metal element in the polyvalent acid metal salt is represented by a metal element M, and the ratio of the metal element M in the constituent element ratio of the surface of the toner particle, the constituent element ratio being determined from a spectrum obtained by the X-ray photoelectron spectroscopy of the toner particle, is represented by M1 (atm %), the M1 is 1.0 (atm %) or more and 10.0 (atm %) or less.

In addition, a toner obtained as follows is adopted as a toner (a): 1 g of the toner is dispersed in a mixed aqueous solution formed of 31 g of a 61.5% aqueous solution of sucrose and 6 g of a 10% aqueous solution of a neutral detergent for washing a precision measuring unit, which is formed of a nonionic surfactant and an anionic surfactant, and the resultant is subjected to such a treatment (a) as to be shaken with a shaker 300 times per 1 minute. When the ratio of the metal element M in the constituent element ratio of the surface of the toner particle, the constituent element ratio being determined from a spectrum obtained by the X-ray photoelectron spectroscopy of the toner (a), is represented by M2 (atm %), it is preferred that both of the M1 and the M2 be 1.0 (atm %) or more and 10.0 (atm %) or less, and the M1 and the M2 satisfy the following expression (ME-1).

$$0.90 \leq M2/M1 \quad \text{(ME-1)}$$

In the treatment (a), the polyvalent acid metal salt weakly adhering to the surface of the toner particle can be removed. Specifically, the polyvalent acid metal salt caused to adhere to the toner base particle by a dry process is easily removed by the treatment (a). Therefore, the treatment (a) enables the evaluation of the sticking state of the polyvalent acid metal salt present on the surface of the toner particle, and smaller changes of the respective parameters by the treatment (a) mean that the polyvalent acid metal salt more strongly sticks to the toner base particle.

The M1 and the M2 represent the states of coverage of the surface of the toner particle with the polyvalent acid metal salt before and after the treatment (a), respectively. In addition, a state of coverage of the surface of the toner particle with the polyvalent acid metal salt contributes to the chargeability of the toner and charge mobility.

When both of the M1 and the M2 are 1.0 (atm %) or more and 10.0 (atm %) or less, the negative chargeability of the toner and the charge mobility become satisfactory. Accordingly, the transfer of charge from the electrophotographic photosensitive member to the toner becomes smoother, and hence a fogging-reducing effect is easily obtained. The M1 and the M2 are more preferably 1.0 (atm %) or more and 7.0 (atm %) or less, still more preferably 1.5 (atm %) or more and 5.0 (atm %) or less.

The expression (ME-1) means the ratio at which the polyvalent acid metal salt remains on the surface of the toner particle without peeling therefrom in the treatment (a). When the ratio M2/M1 is 0.90 or more, the polyvalent acid metal salt strongly sticks to the surface of the toner particle, and hence the migration of the polyvalent acid metal salt from the toner to the surface of the photosensitive member is suppressed. Accordingly, in such toner, the negative chargeability of the surface of the toner particle and the positive chargeability of the surface of the photosensitive member are easily maintained, and hence the toner has such excellent durability that fogging can be stably reduced even when the toner is used over a long time period. In addition, the ratio M2/M1 is more preferably 0.95 or more.

<Method of Forming Protruded Portion Containing Organosilicon Polymer>

A method of forming the protruded portion containing the organosilicon polymer on the toner particle is not particularly limited, and a conventionally known method may be used. Specific examples thereof include: a method including condensing a compound described in the section of the organosilicon compound in the aqueous medium having dispersed therein the toner base particle to form the protruded portion on the toner base particle; and a method including causing the protruded portion containing the organosilicon polymer to adhere onto the toner base particle based on a dry process or a wet process with a mechanical external force.

Of those, the method including condensing the compound described in the section of the organosilicon compound in the aqueous medium having dispersed therein the toner base particle to form the protruded portion on the toner base particle is preferred because the toner base particle and the protruded portion can be strongly stuck to each other. Detailed description is given below.

When the protruded portion is formed on the toner base particle by the method, the method preferably includes: a step of dispersing the toner base particle in the aqueous medium to provide a toner base particle-dispersed liquid (step 1); and a step of mixing the organosilicon compound (or a hydrolysate thereof) in the toner base particle-dispersed liquid, followed by the performance of the condensation reaction of the organosilicon compound in the toner base particle-dispersed liquid to form the protruded portion containing the organosilicon polymer on the toner base particle (step 2).

Examples of a method of obtaining the toner base particle-dispersed liquid in the step 1 include: a method including using the dispersion liquid of the toner base particle produced in the aqueous medium as it is; and a method including loading a dry toner base particle into the aqueous medium and mechanically dispersing the toner base particle therein. When the dry toner base particle is dispersed in the aqueous medium, a dispersion aid may be used.

As the dispersion aid, for example, a known dispersion stabilizer or surfactant may be used. Specific examples of the dispersion stabilizer include: inorganic dispersion stabilizers, such as tricalcium phosphate, hydroxyapatite, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina; and organic dispersion stabilizers, such as polyvinyl alcohol, gelatin, methyl cellulose, methylhydroxypropyl cellulose, ethyl cellulose, a sodium salt of carboxymethyl cellulose, and starch. In addition, examples of the surfactant include: anionic surfactants, such as an alkylsulfuric acid ester salt, an alkylbenzenesulfonic acid salt, and a fatty acid salt; nonionic surfactants, such as a polyoxyethylene alkyl ether and a polyoxypropylene alkyl ether; and cationic surfactants, such as an alkylamine salt and a quaternary ammonium salt. Of those, an inorganic dispersion stabilizer is preferably included, and a dispersion stabilizer containing a phosphoric acid salt, such as tricalcium phosphate, hydroxyapatite, magnesium phosphate, zinc phosphate, or aluminum phosphate, is more preferably included.

In the step 2, the organosilicon compound may be added as it is to the toner base particle-dispersed liquid, or may be added to the toner base particle-dispersed liquid after its hydrolysis. Of those methods, the method including adding the compound after its hydrolysis is preferred because the condensation reaction is easily controlled, and hence the amount of the organosilicon compound remaining in the toner base particle-dispersed liquid can be reduced. The hydrolysis is preferably performed in an aqueous medium whose pH has been adjusted with a known acid and a known base. It has been known that the hydrolysis of the organosilicon compound has pH dependence, and the pH when the hydrolysis is performed is preferably changed in accordance with the kind of the organosilicon compound as appropriate. For example, when methyltriethoxysilane is used as the organosilicon compound, the pH of the aqueous medium is preferably 2.0 or more and 6.0 or less.

Examples of the acid for adjusting the pH include: inorganic acids, such as hydrochloric acid, hydrobromic acid, hydroiodic acid, hypochloric acid, chlorous acid, chloric acid, perchloric acid, hypobromic acid, bromous acid, bromic acid, perbromic acid, hypoiodic acid, iodous acid, iodic acid, periodic acid, sulfuric acid, nitric acid, phosphoric acid, and boric acid; and organic acids, such as acetic acid, citric acid, formic acid, gluconic acid, lactic acid, oxalic acid, and tartaric acid.

Examples of the base for adjusting the pH include: alkali metal hydroxides, such as potassium hydroxide, sodium hydroxide, and lithium hydroxide, and aqueous solutions thereof; alkali metal carbonic acid salts, such as potassium carbonate, sodium carbonate, and lithium carbonate, and aqueous solutions thereof; alkali metal sulfuric acid salts, such as potassium sulfate, sodium sulfate, and lithium sulfate, and aqueous solutions thereof; alkali metal phosphoric acid salts, such as potassium phosphate, sodium phosphate, and lithium phosphate, and aqueous solutions thereof; alkaline earth metal hydroxides, such as calcium hydroxide and magnesium hydroxide, and aqueous solutions thereof; ammonia; and amines, such as triethylamine.

The condensation reaction in the step 2 is preferably controlled by adjusting the pH of the toner base particle-dispersed liquid. It has been known that the condensation reaction of the organosilicon compound has pH dependence, and the pH when the condensation reaction is performed is preferably changed in accordance with the kind of the organosilicon compound as appropriate. For example, when methyltriethoxysilane is used as the organosilicon compound, the pH of the aqueous medium is preferably 6.0 or more and 12.0 or less. The adjustment of the pH enables the control of the protrusion height H and protrusion width W of the protruded portion according to at least one embodiment of the present invention, and hence makes it easier to obtain the effects of the present invention. The acids and the bases listed in the section of the hydrolysis may each be used as an acid and a base for adjusting the pH.

<Methods of Measuring Weight-Average Particle Diameter (D4) and Number-Average Particle Diameter (D1) of Toner Particles>

The weight-average particle diameter (D4) and number-average particle diameter (D1) of the toner particles are calculated as described below.

A precision particle size distribution measuring apparatus based on a pore electrical resistance method with a 100-micrometer aperture tube "Coulter Counter Multisizer 3" (trademark) (manufactured by Beckman Coulter, Inc.) is used as a measuring apparatus. Dedicated software included therewith "Beckman Coulter Multisizer 3 Version 3.51" (manufactured by Beckman Coulter, Inc.) is used for setting measurement conditions and analyzing measurement data. The measurement is performed with the number of effective measurement channels of 25,000.

An electrolyte aqueous solution prepared by dissolving reagent grade sodium chloride in ion-exchanged water so as to have a concentration of 1.0%, for example, "ISOTON II" (product name) (manufactured by Beckman Coulter, Inc.) may be used in the measurement.

The dedicated software is set as described below prior to the measurement and the analysis.

In the "Change Standard Operating Method (SOMME)" screen of the dedicated software, the total count number of a control mode is set to 50,000 particles, the number of times of measurement is set to 1, and a value obtained by using "standard particles each having a particle diameter of 10.0 μm" (product name) (manufactured by Beckman Coulter, Inc.) is set as a Kd value.

A threshold and a noise level are automatically set by pressing a "Threshold/Measure Noise Level button". In addition, a current is set to 1,600 μA, a gain is set to 2, and an electrolyte aqueous solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described below.

(1) 200.0 Millilters of the electrolyte aqueous solution is charged into a 250-milliliter round-bottom beaker made of glass dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "Flush Aperture Tube" function of the dedicated software.

(2) 30.0 Milliliters of the electrolyte aqueous solution is charged into a 100-milliliter flat-bottom beaker made of glass. 0.3 Milliliter of a diluted solution prepared by diluting "Contaminon N" (product name) (10% aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three parts by mass fold is added as a dispersant to the electrolyte aqueous solution.

(3) An ultrasonic dispersing unit "Ultrasonic Dispersion System Tetra 150" (product name) (manufactured by Nikkaki Bios Co., Ltd.) in which two oscillators each having an oscillatory frequency of 50 kHz are built so as to be out of phase by 180° and which has an electrical output of 120 W is prepared. 3.3 Liters of ion-exchanged water is charged into the water tank of the ultrasonic dispersing unit. 2.0 Milliliters of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) 10 Milligrams of the toner particles are gradually added to and dispersed in the electrolyte aqueous solution in the beaker in the section (4) under a state in which the electrolyte aqueous solution is irradiated with the ultrasonic wave. Then, the ultrasonic dispersion treatment is continued for an additional 60 seconds. The temperature of water in the water tank is appropriately adjusted so as to be 10° C. or more and 40° C. or less upon ultrasonic dispersion.

(6) The electrolyte aqueous solution in the section (5) in which the toner particles have been dispersed is dropped with a pipette to the round-bottom beaker in the section (1) placed in the sample stand, and the concentration of the toner particles to be measured is adjusted to 5 mass %. Then, measurement is performed until the particle diameters of 50,000 particles are measured.

(7) The measurement data is analyzed with the dedicated software included with the apparatus, and the weight-average particle diameter (D4) and the number-average particle diameter (D1) are calculated. The "Average Diameter" on the "Analysis/Volume Statistics (Arithmetic Average)" screen of the dedicated software when the dedicated software is set to show a graph in a vol % unit is the weight-average particle diameter (D4). In addition, the "Average Diameter" on the "Analysis/Number Statistics (Arithmetic Average)" screen of the dedicated software when the dedicated software is set to show a graph in a number % unit is the number-average particle diameter (D1).

[Electrophotographic Photosensitive Member]

In at least one embodiment of the present invention, the electrophotographic photosensitive member is characterized by containing, in its surface layer, the resin including the siloxane segment.

A method of producing the electrophotographic photosensitive member is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Now, the respective layers are described.

<Support>

In at least one embodiment of the present invention, the electrophotographic photosensitive member includes the support. The support is preferably a conductive support having conductivity. In addition, examples of the shape of the support include a cylindrical shape, a belt shape, and a sheet shape. Of those, a cylindrical support is preferred. In addition, the surface of the support may be subjected to, for example, electrochemical treatment, such as anodization, blast treatment, or cutting treatment.

A metal, a resin, or glass is preferred as a material for the support.

Examples of the metal include aluminum, iron, nickel, copper, gold, stainless steel, and alloys thereof. Of those, an aluminum support using aluminum is preferred.

In addition, conductivity may be imparted to the resin or the glass through treatment involving, for example, mixing or coating the resin or the glass with a conductive material.

<Conductive Layer>

The conductive layer may be arranged on the support. The arrangement of the conductive layer can conceal flaws and irregularities in the surface of the support, and control the reflection of light on the surface of the support.

The conductive layer preferably contains conductive particles and a resin.

A material for the conductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the conductive particles, and in particular, titanium oxide, tin oxide, and zinc oxide are more preferably used.

When the metal oxide is used as the conductive particles, the surface of the metal oxide may be treated with a material, such as a silane coupling agent, or the metal oxide may be doped with an element, such as phosphorus, aluminum, or niobium, or an oxide thereof.

Each of the conductive particles may be of a laminated construction having a core particle and a coating layer coating the core particle. Examples of the core particle include titanium oxide, barium sulfate, and zinc oxide. The coating layer is, for example, a metal oxide, such as tin oxide or titanium oxide.

When the metal oxide is used as the conductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

The conductive layer may further contain a concealing agent, such as a silicone oil, resin particles, or titanium oxide.

The conductive layer has an average thickness of preferably 1 μm or more and 50 μm or less, particularly preferably 3 μm or more and 40 μm or less.

The conductive layer may be formed by preparing a coating liquid for a conductive layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for a conductive layer, there are given methods using a paint shaker, a sand mill, a ball mill, and a liquid collision-type high-speed disperser.

<Undercoat Layer>

The undercoat layer may be arranged on the support or the conductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

The undercoat layer may further contain an electron-transporting substance, a metal oxide, a metal, and a conductive polymer for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

The surface of the metal oxide may be treated with a material, such as a silane coupling agent, or the metal oxide may be doped with an element, such as phosphorus, aluminum, or niobium, or an oxide thereof.

In addition, the undercoat layer may further contain an additive.

The undercoat layer has an average thickness of preferably 0.1 μm or more and 50 μm or less, more preferably 0.2 μm or more and 40 μm or less, particularly preferably 0.3 μm or more and 30 μm or less.

The undercoat layer may be formed by preparing a coating liquid for an undercoat layer containing the above-mentioned materials and a solvent, forming a coat thereof, and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

The photosensitive layers of electrophotographic photosensitive members are mainly classified into (1) a laminated photosensitive layer and (2) a single-layer photosensitive layer. (1) The laminated photosensitive layer has a charge-generating layer containing a charge-generating substance and a charge-transporting layer containing a charge-transporting substance. (2) The single-layer photosensitive layer has a photosensitive layer containing both a charge-generating substance and a charge-transporting substance.

(1) Laminated Photosensitive Layer

The laminated photosensitive layer includes the charge-generating layer and the charge-transporting layer.

(1-1) Charge-generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The charge-generating layer has an average thickness of preferably 0.1 μm or more and 1 μm or less, more preferably 0.15 μm or more and 0.4 μm or less.

The charge-generating layer may be formed by preparing a coating liquid for a charge-generating layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(1-2) Charge-Transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The charge-transporting layer has an average thickness of 5 μm or more and 50 μm or less, more preferably 8 μm or more and 40 μm or less, particularly preferably 10 μm or more and 17 μm or less.

The charge-transporting layer may be formed by preparing a coating liquid for a charge-transporting layer containing the above-mentioned materials and a solvent, forming a coat thereof, and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-layer Photosensitive Layer

The single-layer photosensitive layer may be formed by preparing a coating liquid for a photosensitive layer containing the charge-generating substance, the charge-transporting substance, a resin, and a solvent, forming a coat thereof, and drying the coat. Examples of the charge-generating substance, the charge-transporting substance, and the resin are the same as those of the materials in the section "(1) Laminated Photosensitive Layer."

<Surface Layer>

When the photosensitive layer is the laminated photosensitive layer, the surface layer in at least one embodiment of the present invention represents the charge-transporting layer, and when the photosensitive layer is the single-layer photosensitive layer, the surface layer represents the photosensitive layer. In addition, when a protective layer is arranged on the photosensitive layer, the surface layer in at least one embodiment of the present invention represents the protective layer.

The electrophotographic photosensitive member according to at least one embodiment of the present invention is characterized by containing, in its surface layer, the resin including the siloxane segment.

The resin including the siloxane segment in at least one embodiment of the present invention is a resin having a siloxane segment in a structure for forming the resin. Therefore, when the surface layer is the photosensitive layer, the layer contains the resin having the siloxane segment as the resin for a charge-transporting layer.

An arbitrary resin including a siloxane segment may be applied as the resin including the siloxane segment. Of such resins, a polycarbonate resin including a siloxane segment or a polyester resin including a siloxane segment is preferred as the resin including the siloxane segment.

The siloxane segment of the polycarbonate resin including the siloxane segment or the polyester resin including the siloxane segment is preferably a structure represented by the formula (A), a structure represented by the formula (B), or a structure represented by the formula (C).

(A)

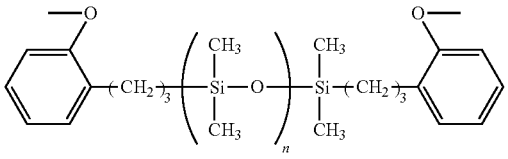

In the formula (A), "n" represents the average of the number of repetitions of a structure in parentheses, and represents 10 or more and 120 or less. "n" preferably represents 20 or more and 80 or less from the viewpoint of the maintenance of the durability of the electrophotographic photosensitive member at the time of its repeated use.

(B)

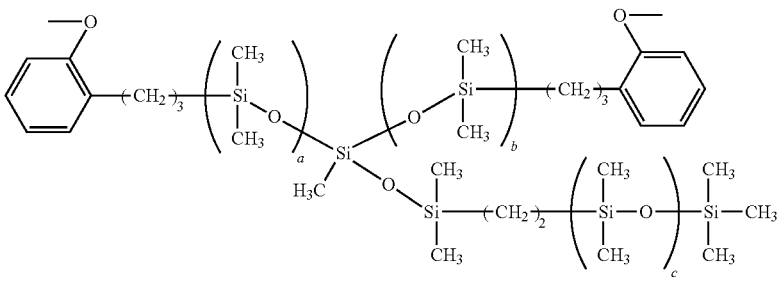

In the formula (B), "a", "b", and "c" each independently represent the average of the number of repetitions of a structure in parentheses, and "a" and "b" each represent 1 or more and 10 or less, and "c" represents 20 or more and 200 or less. "a" and "b" each preferably represent 1 or more and 5 or less, and "c" preferably represents 20 or more and 80 or less from the viewpoint of the maintenance of the durability of the electrophotographic photosensitive member at the time of its repeated use.

(c)

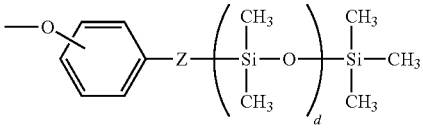

In the formula (C), "d" represents the average of the number of repetitions of a structure in parentheses, and represents 10 or more and 120 or less, and Z represents an alkylene group having 3 or less carbon atoms. "d" preferably represents 20 or more and 80 or less from the viewpoint of the maintenance of the durability of the electrophotographic photosensitive member at the time of its repeated use.

The resin including the siloxane segment is specifically described below.

A polycarbonate resin including a siloxane segment having a structure represented by the formula (A) is specifically, for example, a resin having a structural unit represented by the formula (A-PC).

(A-PC)

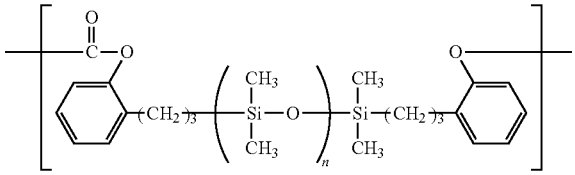

A polycarbonate resin including a siloxane segment having a structure represented by the formula (B) is specifically, for example, a resin having a structural unit represented by the formula (B-PC).

(B-PC)

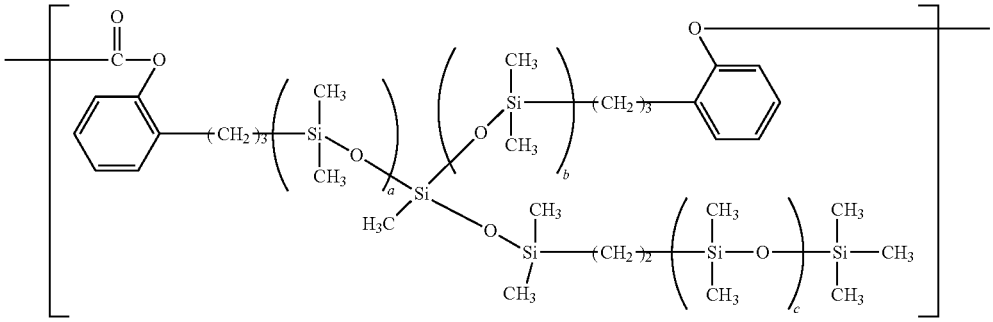

A polycarbonate resin including a siloxane segment having a structure represented by the formula (C) is specifically, for example, a resin having a structural unit represented by the formula (C-PC).

(C-PC)

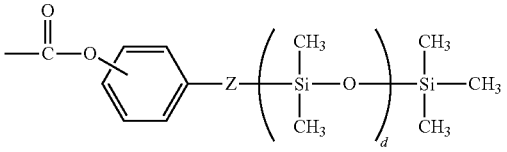

The polycarbonate resin including the siloxane segment, which has a structural unit represented by the formula (A-PC) or the formula (B-PC), or a structural unit represented by the formula (C-PC) at a terminal thereof, may be a copolymer resin with any other structural unit. The other structural unit is, for example, a structural unit represented by the formula (PC).

(PC)

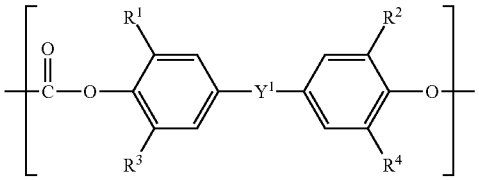

In the formula (PC), $R^1$ to $R^4$ each independently represent a hydrogen atom or a methyl group, and $Y^1$ represents a methylene group that may have an alkyl group or a phenyl group as a substituent, a cyclohexylidene group, an oxygen atom, or a single bond.

Specific examples of the structural unit represented by the formula (PC) are given below.

(PC-1)

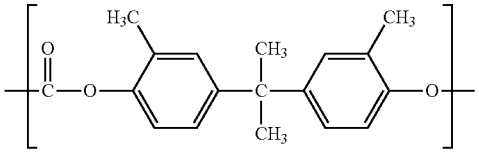

(PC-2)

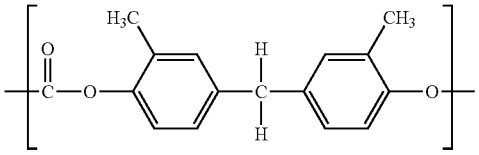

(PC-3)

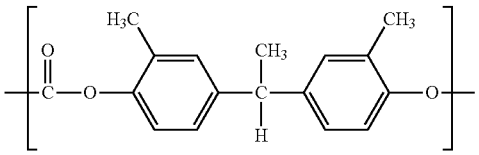

-continued (PC-4)

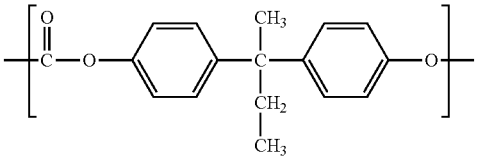

(PC-5)

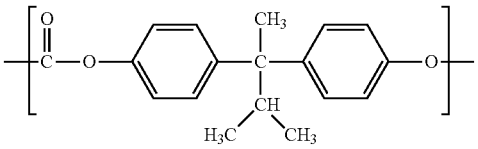

(PC-6)

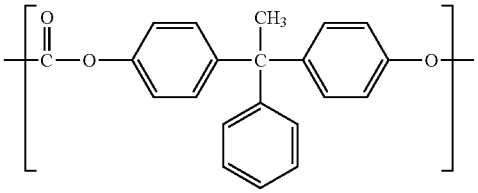

(PC-7)

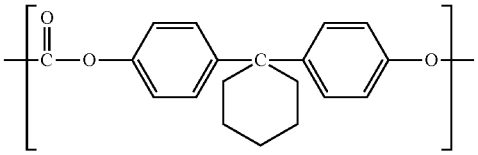

(PC-8)

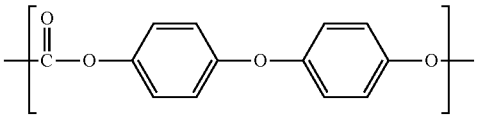

(PC-9)

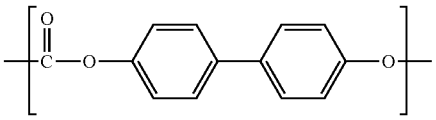

Of those, the structural unit represented by the formula (PC-1), (PC-5), (PC-7), (PC-8), or (PC-9) is preferred, and the structural unit represented by the formula (PC-7) is particularly preferred.

The polycarbonate resin including the siloxane segment may be a polycarbonate resin obtained by combining a plurality of structural units selected from a structural unit represented by the formula (A-PC) or the formula (B-PC) and a structural unit represented by the formula (PC).

When the polycarbonate resin including the siloxane segment has a structural unit represented by the formula (PC) in addition to a structural unit represented by the formula (A-PC) or a structural unit represented by the formula (B-PC), the total content of the structural unit represented by the formula (A-PC) and the structural unit represented by the formula (B-PC) with respect to the total mass of the polycarbonate resin including the siloxane segment is preferably 6 mass % or more and 40 mass % or less. In addition, the content of the structural unit represented by the formula (PC) with respect to the total mass of the polycarbonate resin including the siloxane segment is preferably 60 mass % or more and 94 mass % or less. It is more preferred that the total content of the structural unit represented by the formula (A-PC) and the structural unit represented by the formula (B-PC) with respect to the total mass of the polycarbonate resin including the siloxane segment be 10 mass % or more and 20 mass % or less, and the content of the structural unit represented by the formula (PC) with respect to the total mass of the polycarbonate resin including the siloxane segment be 60 mass % or more and 90 mass % or less.

When the polycarbonate resin including the siloxane segment has a structural unit represented by the formula (PC) in addition to a structural unit represented by the formula (A-PC) or a structural unit represented by the formula (B-PC), the polycarbonate resin including the siloxane segment is a copolymer including the structural unit represented by the formula (A-PC) or the structural unit represented by the formula (B-PC), and the structural unit represented by the formula (PC). The copolymerization form of the polycarbonate resin may be any one of forms, such as block copolymerization, random copolymerization, and alternating copolymerization.

The polycarbonate resin including the siloxane segment may be a resin having a structural unit represented by the formula (C-PC) at a terminal of a polycarbonate resin obtained by combining a plurality of structures selected from structural units each represented by the formula (PC).

When the polycarbonate resin including the siloxane segment has the structural unit represented by the formula (C-PC) at the terminal of the polycarbonate resin including the structures each represented by the formula (PC), the content of the structural unit represented by the formula (C-PC) with respect to the total mass of the polycarbonate resin including the siloxane segment is preferably 0.5 mass % or more and 3 mass % or less. The content is more preferably 0.8 mass % or more and 2 mass % or less.

The weight-average molecular weight of the polycarbonate resin including the siloxane segment is preferably 30,000 or more and 200,000 or less. The weight-average molecular weight is more preferably 40,000 or more and 150,000 or less. The weight-average molecular weight is a weight-average molecular weight in terms of polystyrene measured in accordance with an ordinary method, specifically by a method described in Japanese Patent Application Laid-Open No. 2007-79555.

The copolymerization ratio of the polycarbonate resin including the siloxane segment may be identified by a conversion method based on the peak area ratio of hydrogen atoms (hydrogen atoms for forming the resin) obtained by the $^{1}$H-NMR measurement of the resin, which is a general approach.

Examples of the polycarbonate resin including the siloxane segment according to at least one embodiment of the present invention are listed in Tables 1 to 3.

TABLE 1

| | n | (PC) | (A-PC)/(PC) | Mw |
|---|---|---|---|---|
| (A-PC-1) | 20 | (PC-7) | 6/94 | 120,000 |
| (A-PC-2) | 20 | (PC-7) | 10/90 | 120,000 |
| (A-PC-3) | 20 | (PC-7) | 20/80 | 100,000 |
| (A-PC-4) | 20 | (PC-7) | 40/60 | 140,000 |
| (A-PC-5) | 20 | (PC-1) | 10/90 | 120,000 |
| (A-PC-6) | 20 | (PC-7)/(PC-8) = 2/8 | 10/90 | 120,000 |
| (A-PC-7) | 20 | (PC-7)/(PC-9) = 3/7 | 10/90 | 120,000 |
| (A-PC-8) | 10 | (PC-7) | 20/80 | 90,000 |

TABLE 1-continued

| | n | (PC) | (A-PC)/(PC) | Mw |
|---|---|---|---|---|
| (A-PC-9) | 40 | (PC-7) | 10/90 | 90,000 |
| (A-PC-10) | 80 | (PC-7) | 6/94 | 100,000 |
| (A-PC-11) | 120 | (PC-7) | 3/97 | 120,000 |

In Table 1, polycarbonate resins each including a structural unit represented by the formula (A-PC) and a structural unit represented by the formula (PC) are listed. In Table 1, the column "n" shows the values of "n" in the formula (A-PC). The column "(PC)" shows specific examples of the structural unit represented by the formula (PC). The column "(A-PC)/(PC)" shows the copolymerization ratios (mass ratios) of the structural unit represented by the formula (A-PC) to the structural unit represented by the formula (PC). The column "Mw" shows the weight-average molecular weights of the polycarbonate resins.

TABLE 2

| | a | b | c | (PC) | (B-PC)/(PC) | Mw |
|---|---|---|---|---|---|---|
| (B-PC-1) | 5 | 5 | 20 | (PC-7) | 10/90 | 100,000 |
| (B-PC-2) | 5 | 5 | 40 | (PC-7) | 10/90 | 90,000 |
| (B-PC-3) | 5 | 5 | 60 | (PC-7) | 10/90 | 110,000 |
| (B-PC-4) | 5 | 5 | 80 | (PC-7) | 10/90 | 80,000 |
| (B-PC-5) | 5 | 5 | 100 | (PC-7) | 5/95 | 80,000 |
| (B-PC-6) | 3 | 3 | 80 | (PC-7) | 10/90 | 100,000 |
| (B-PC-7) | 10 | 10 | 20 | (PC-7) | 10/90 | 80,000 |
| (B-PC-8) | 5 | 5 | 40 | (PC-7) | 6/94 | 90,000 |
| (B-PC-9) | 5 | 5 | 40 | (PC-7) | 20/80 | 90,000 |
| (B-PC-10) | 5 | 5 | 40 | (PC-1) | 6/94 | 100,000 |
| (B-PC-11) | 5 | 5 | 40 | (PC-7)/(PC-9) = 3/7 | 3/97 | 120,000 |

In Table 2, polycarbonate resins each including a structural unit represented by the formula (B-PC) and a structural unit represented by the formula (PC) are listed. In Table 2, the columns "a", "b", and "c" show the values of "a" in the formula (B-PC), the values of "b" therein, and the values of "c" therein, respectively. The column "(PC)" shows specific examples of the structural unit represented by the formula (PC). The column "(B-PC)/(PC)" shows the copolymerization ratios (mass ratios) of the structural unit represented by the formula (B-PC) to the structural unit represented by the formula (PC). The column "Mw" shows the weight-average molecular weights of the polycarbonate resins.

TABLE 3

| | d | Z | (PC) | Mw |
|---|---|---|---|---|
| (C-PC-1) | 20 | 3 | (PC-7) | 80,000 |
| (C-PC-2) | 40 | 3 | (PC-7) | 80,000 |
| (C-PC-3) | 80 | 3 | (PC-7) | 100,000 |
| (C-PC-4) | 100 | 3 | (PC-7) | 80,000 |
| (C-PC-5) | 10 | 2 | (PC-1) | 100,000 |
| (C-PC-6) | 20 | 3 | (PC-7)/(PC-8) = 2/8 | 80,000 |
| (C-PC-7) | 20 | 3 | (PC-7)/(PC-9) = 3/7 | 80,000 |

In Table 3, polycarbonate resins each including a structural unit represented by the formula (C-PC) and a structural unit represented by the formula (PC) are listed. In Table 3, the column "d" shows the values of "d" in the formula (C-PC). Values in the column "Z" each represent the number of carbon atoms for forming an alkylene group. The column "(PC)" shows structural units for forming the main chains of the polycarbonate resins. The column "Mw" shows the weight-average molecular weights of the polycarbonate resins.

The polycarbonate resin is preferably the polycarbonate resin (A-PC-1), (A-PC-2), (A-PC-3), (B-PC-1), (B-PC-2), (B-PC-3), (C-PC-1), or (C-PC-2) out of those polycarbonate resins, and is particularly preferably the polycarbonate resin (A-PC-2), (B-PC-2), or (C-PC-2).

A polyester resin including a siloxane segment having a structure represented by the formula (A) is specifically, for example, a resin having a structural unit represented by the formula (A-E).

(A-E)

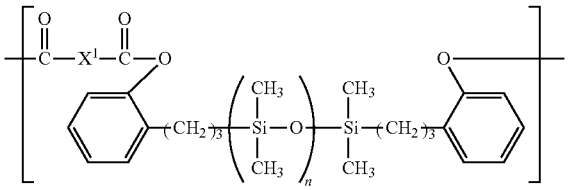

In the formula (A-E), $X^1$ represents a m-phenylene group, a p-phenylene group, or a divalent group obtained by bonding two p-phenylene groups through an oxygen atom.

A polyester resin including a siloxane segment having a structure represented by the formula (B) is specifically, for example, a resin having a structural unit represented by the formula (B-E).

(B-E)

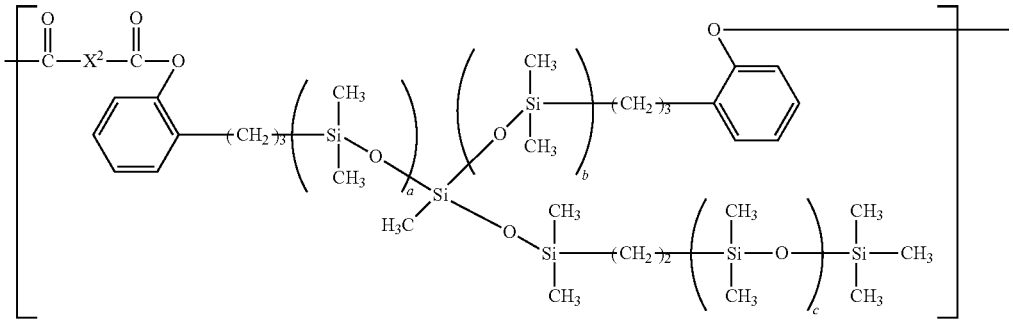

In the formula (B-E), $X^2$ represents a m-phenylene group, a p-phenylene group, or a divalent group obtained by bonding two p-phenylene groups through an oxygen atom.

A polycarbonate resin including a siloxane segment having a structure represented by the formula (C) is specifically, for example, a resin having a structural unit represented by the formula (C-E) at a terminal thereof.

(C-E)

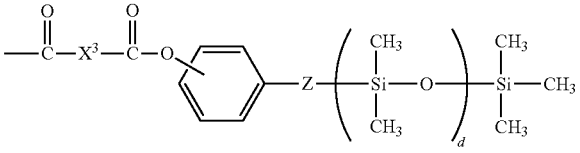

In the formula (C-E), $X^3$ represents a m-phenylene group, a p-phenylene group, or a divalent group obtained by bonding two p-phenylene groups through an oxygen atom.

The polyester resin including the siloxane segment, which has a structural unit represented by the formula (A-E) or the formula (B-E), or a structural unit represented by the formula (C-E) at a terminal thereof, may be a copolymer resin with any other structural unit. The other structural unit is, for example, a structural unit represented by the formula (E).

(E)

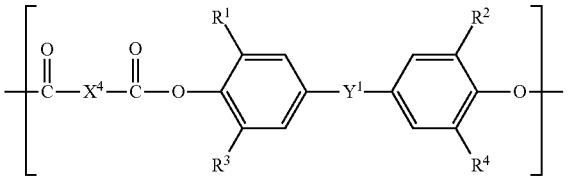

In the formula (E), $R^5$ to $R^8$ each independently represent a hydrogen atom or a methyl group, and $Y^2$ represents a methylene group that may have an alkyl group as a substituent, a cyclohexylidene group, an oxygen atom, or a single bond. $X^4$ represents a m-phenylene group, a p-phenylene group, or a divalent group obtained by bonding two p-phenylene groups through an oxygen atom.

Specific examples of the structural unit represented by the formula (E) are given below.

(E-1)
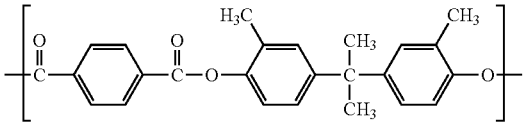
(E-2)
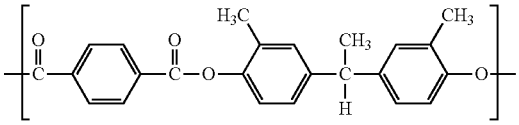
(E-3)
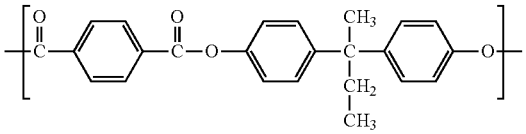
(E-4)
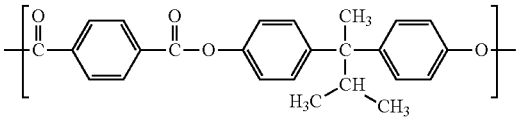
(E-5)
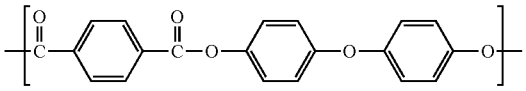
(E-6)
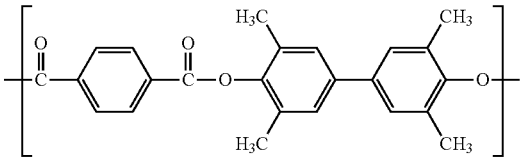
(E-7)
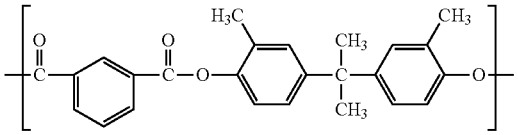
(E-8)
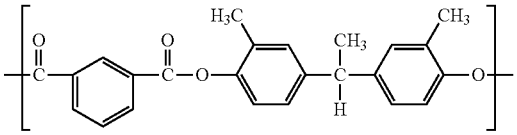
(E-9)
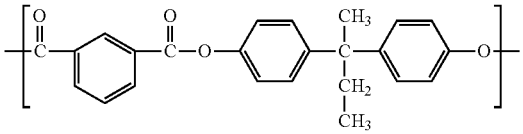
(E-10)
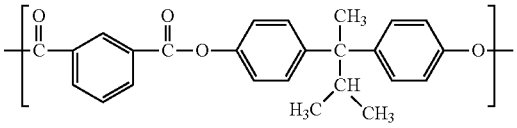
(E-11)
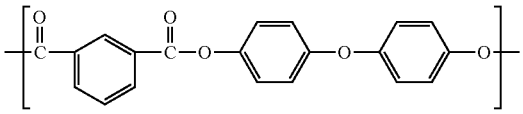
(E-12)
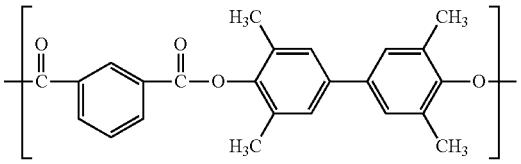
(E-13)
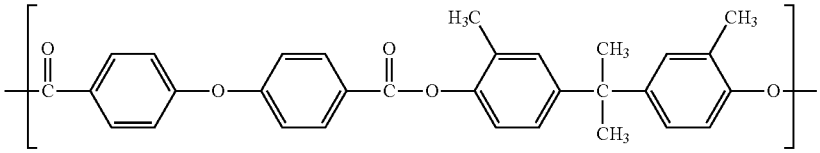
(E-14)
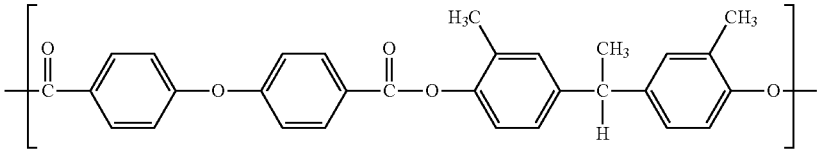
(E-15)
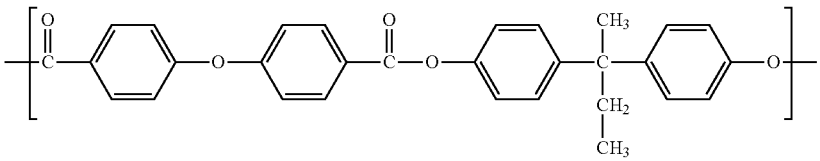

-continued (E-16)

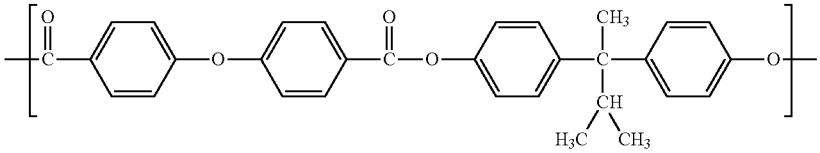

(E-17)

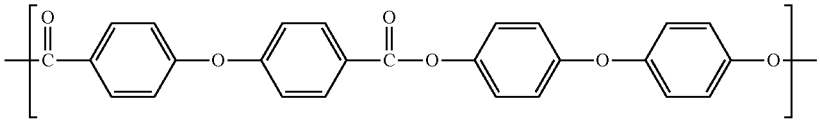

(E-18)

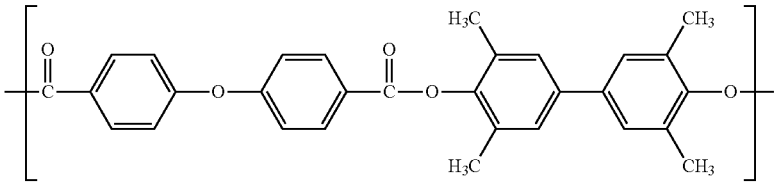

Of those, the structural unit represented by the formula (E-1), (E-7), (E-13), (E-14), or (E-18) is preferred, and the structural unit represented by the formula (E-1) or (E-7) is particularly preferred.

The polyester resin including the siloxane segment may be a polyester resin obtained by combining a plurality of structural units selected from a structural unit represented by the formula (A-E) or a structural unit represented by the formula (B-E) and a structural unit represented by the formula (E).

When the polyester resin including the siloxane segment has a structural unit represented by the formula (E) in addition to a structural unit represented by the formula (A-E) or a structural unit represented by the formula (B-E), the total content of the structural unit represented by the formula (A-E) and the structural unit represented by the formula (B-E) with respect to the total mass of the polyester resin including the siloxane segment is preferably 6 mass % or more and 40 mass % or less. In addition, the content of the structural unit represented by the formula (E) with respect to the total mass of the polyester resin including the siloxane segment is preferably 60 mass % or more and 94 mass % or less. It is more preferred that the total content of the structural unit represented by the formula (A-E) and the structural unit represented by the formula (B-E) with respect to the total mass of the polyester resin including the siloxane segment be 10 mass % or more and 20 mass % or less, and the content of the structural unit represented by the formula (E) with respect to the total mass of the polyester resin including the siloxane segment be 60 mass % or more and 90 mass % or less.

When the polyester resin including the siloxane segment has a structural unit represented by the formula (E) in addition to a structural unit represented by the formula (A-E) or a structural unit represented by the formula (B-E), the polyester resin including the siloxane segment is a copolymer including the structural unit represented by the formula (A-E) or the structural unit represented by the formula (B-E), and the structural unit represented by the formula (E). The copolymerization form of the resin may be any one of forms, such as block copolymerization, random copolymerization, and alternating copolymerization.

The polyester resin including the siloxane segment may be a resin having a structural unit represented by the formula (C-E) at a terminal of a polyester resin obtained by combining a plurality of structures selected from structural units each represented by the formula (E).

When the polyester resin including the siloxane segment has the structural unit represented by the formula (C-E) at the terminal of the polyester resin including the structures each represented by the formula (E), the content of the structural unit represented by the formula (C-E) with respect to the total mass of the polyester resin including the siloxane segment is preferably 0.5 mass % or more and 3 mass % or less. The content is more preferably 0.8 mass % or more and 2 mass % or less.

The weight-average molecular weight of the polyester resin including the siloxane segment is preferably 50,000 or more and 150,000 or less. The weight-average molecular weight is more preferably 60,000 or more and 120,000 or less. The weight-average molecular weight is a weight-average molecular weight in terms of polystyrene measured in accordance with an ordinary method, specifically by a method described in Japanese Patent Application Laid-Open No. 2007-79555.

The copolymerization ratio of the polyester resin including the siloxane segment may be identified by a conversion method based on the peak area ratio of hydrogen atoms (hydrogen atoms for forming the resin) obtained by the $^{1}$H-NMR measurement of the resin, which is a general approach.

Examples of the polyester resin including the siloxane segment according to at least one embodiment of the present invention are listed in Tables 4 to 6.

TABLE 4

| | Value of "n" | $X^1$ | (E) | (A-E)/(E) | Mw |
|---|---|---|---|---|---|
| (A-E-1) | 20 | m-Phenylene/p-phenylene = 5/5 | (E-1)/(E-7) = 5/5 | 6/94 | 120,000 |
| (A-E-2) | 20 | m-Phenylene/p-phenylene = 5/5 | (E-1)/(E-7) = 5/5 | 10/90 | 120,000 |

TABLE 4-continued

| | Value of "n" | $X^1$ | (E) | (A-E)/(E) | Mw |
|---|---|---|---|---|---|
| (A-E-3) | 20 | m-Phenylene/p-phenylene = 5/5 | (E-1)/(E-7) = 5/5 | 20/80 | 120,000 |
| (A-E-4) | 20 | m-Phenylene/p-phenylene = 5/5 | (E-1)/(E-7) = 5/5 | 40/60 | 120,000 |
| (A-E-5) | 20 | Divalent group obtained by bonding two p-phenylene groups through oxygen atom | (E-13) | 10/90 | 100,000 |
| (A-E-6) | 10 | m-Phenylene/p-phenylene = 5/5 | (E-1)/(E-7) = 5/5 | 10/90 | 120,000 |
| (A-E-7) | 40 | m-Phenylene/p-phenylene = 5/5 | (E-1)/(E-7) = 5/5 | 10/90 | 110,000 |
| (A-E-8) | 80 | m-Phenylene/p-phenylene = 5/5 | (E-1)/(E-7) = 5/5 | 20/80 | 100,000 |
| (A-E-9) | 120 | m-Phenylene/p-phenylene = 5/5 | (E-1)/(E-7) = 5/5 | 10/90 | 80,000 |

In Table 4, polyester resins each including a structural unit represented by the formula (A-E) and a structural unit represented by the formula (E) are listed. In Table 4, the columns "Value of "n"" and "X" show the values of "n" in the formula (A-E) and structures for forming $X^1$ therein, respectively. The column "(E)" shows specific examples of the structural unit represented by the formula (E) and their copolymerization ratios (mass ratios). The column "(A-E)/(E)" shows the copolymerization ratios (mass ratios) of the structural unit represented by the formula (A-E) to the structural unit represented by the formula (E). The column "Mw" shows the weight-average molecular weights of the polyester resins.

TABLE 5

| | a | b | c | $X^2$ | (E) | (B-E)/(E) | Mw |
|---|---|---|---|---|---|---|---|
| (B-E-1) | 5 | 5 | 20 | m-Phenylene/p-phenylene = 5/5 | (E-1)/(E-7) = 5/5 | 10/90 | 100,000 |
| (B-E-2) | 5 | 5 | 40 | m-Phenylene/p-phenylene = 5/5 | (E-1)/(E-7) = 5/5 | 10/90 | 100,000 |
| (B-E-3) | 5 | 5 | 60 | m-Phenylene/p-phenylene = 5/5 | (E-1)/(E-7) = 5/5 | 10/90 | 100,000 |
| (B-E-4) | 5 | 5 | 80 | m-Phenylene/p-phenylene = 5/5 | (E-1)/(E-7) = 5/5 | 10/90 | 100,000 |
| (B-E-5) | 5 | 5 | 100 | m-Phenylene/p-phenylene = 5/5 | (E-1)/(E-7) = 5/5 | 5/95 | 100,000 |
| (B-E-7) | 10 | 10 | 20 | Divalent group obtained by bonding two p-phenylene groups through oxygen atom | (E-13) | 10/90 | 80,000 |

In Table 5, polyester resins each including a structural unit represented by the formula (B-E) and a structural unit represented by the formula (E) are listed. In Table 5, the columns "a", "b", "c", and "$X^2$" show the values of "a" in the formula (B-E), the values of "b" therein, and the values of "c" therein, and structures for forming $X^2$ therein, respectively. The column "(E)" shows specific examples of the structural unit represented by the formula (E). The column "(B-E)/(E)" shows the copolymerization ratios (mass ratios) of the structural unit represented by the formula (B-E) to the structural unit represented by the formula (E). The column "Mw" shows the weight-average molecular weights of the polyester resins.

TABLE 6

| | d | Z | $X^3$ | (E) | Mw |
|---|---|---|---|---|---|
| (C-E-1) | 20 | 3 | m-Phenylene/p-phenylene = 5/5 | (E-1)/(E-7) = 5/5 | 100,000 |
| (C-E-2) | 40 | 3 | m-Phenylene/p-phenylene = 5/5 | (E-1)/(E-7) = 5/5 | 80,000 |
| (C-E-3) | 80 | 3 | m-Phenylene/p-phenylene = 5/5 | (E-1)/(E-7) = 5/5 | 80,000 |
| (C-E-4) | 100 | 3 | m-Phenylene/p-phenylene = 5/5 | (E-1)/(E-7) = 5/5 | 80,000 |
| (C-E-5) | 10 | 2 | m-Phenylene/p-phenylene = 5/5 | (E-1)/(E-7) = 5/5 | 100,000 |

TABLE 6-continued

| | d | Z | $X^3$ | (E) | Mw |
|---|---|---|---|---|---|
| (C-E-6) | 20 | 3 | Divalent group obtained by bonding two p-phenylene groups through oxygen atom | (E-13) | 70,000 |

In Table 6, polyester resins each including a structural unit represented by the formula (C-E) and a structural unit represented by the formula (E) are listed. In Table 6, the column "d" shows the values of "d" in the formula (C-E). Values in the column "Z" each represent the number of carbon atoms for forming an alkylene group. The column "V" shows structures for forming $X^3$ in the formula (C-E).

The column "(E)" shows structural units for forming the main chains of the polyester resins. The column "Mw" shows the weight-average molecular weights of the polyester resins.

The polyester resin is preferably the polyester resin (A-E-2), (B-E-2), or (C-E-2) out of those polyester resins.

In at least one embodiment of the present invention, the siloxane segment is a segment including: silicon atoms at both terminals for forming a siloxane moiety and groups bonded thereto; and an oxygen atom, a silicon atom, and groups bonded thereto, the atoms and the groups being sandwiched between the silicon atoms at both terminals. To put it concretely, in at least one embodiment of the present invention, in the case of a structure represented by the formula (A), the siloxane segment is a segment surrounded by a broken line in a structure represented by the formula (A-S).

(A-S)

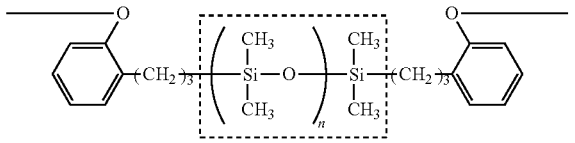

In addition, in the case of a structure represented by the formula (B), the siloxane segment is a segment surrounded by a broken line in a structure represented by the formula (B-S).

(B-S)

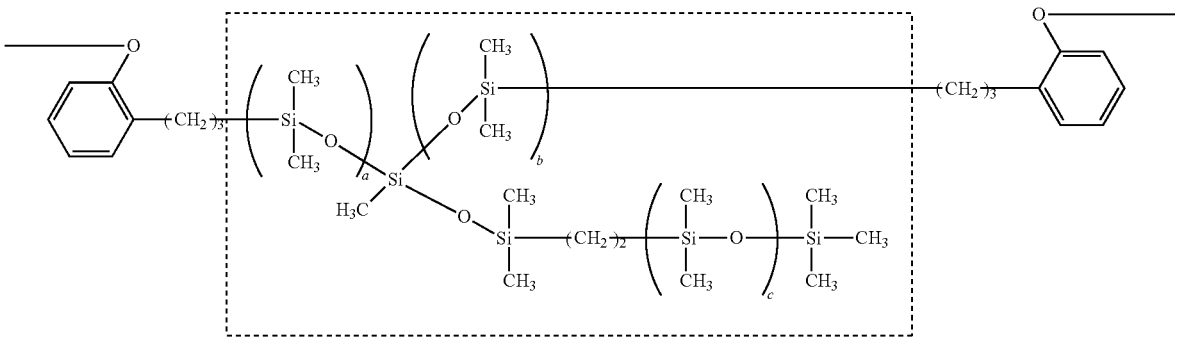

In addition, in the case of a structure represented by the formula (C), the siloxane segment is a segment surrounded by a broken line in a structure represented by the formula (C-S).

(C-S)

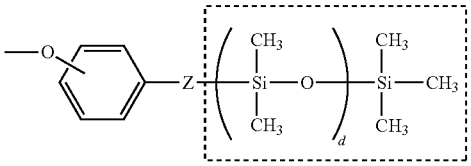

In at least one embodiment of the present invention, the surface layer of the electrophotographic photosensitive member is characterized by containing the resin including the siloxane segment, but may be mixed with a resin free of any siloxane segment. Although such resin is arbitrary, the resin is preferably a polycarbonate resin free of any siloxane segment or a polyester resin free of any siloxane segment in terms of the maintenance of the durability of the electrophotographic photosensitive member along with its repeated use.

The polycarbonate resin free of any siloxane segment preferably has a structural unit represented by the formula (PC). Similarly, the polyester resin free of any siloxane segment preferably has a structural unit represented by the formula (E). The weight-average molecular weight (Mw) of the polycarbonate resin free of any siloxane segment or the polyester resin free of any siloxane segment is preferably 60,000 or more and 160,000 or less in terms of the maintenance of the durability, and is more preferably 80,000 or more and 140,000 or less.

When the resin including the siloxane segment and a resin except the resin including the siloxane segment are used as a mixture in the surface layer, the content of the resin including the siloxane segment with respect to the total mass of constituents in the surface layer is preferably 0.1 mass % or more and 10 mass % or less from the viewpoint of the fogging-reducing effect of the present invention. The content is more preferably 0.3 mass % or more and 8 mass % or less.

[Process Cartridge and Electrophotographic Apparatus]

The process cartridge according to at least one embodiment of the present invention is characterized in that the process cartridge includes a developing unit containing the toner described in the foregoing and the electrophotographic photosensitive member, and is removably mounted onto the main body of an electrophotographic apparatus.

In addition, the electrophotographic apparatus according to at least one embodiment of the present invention is characterized by including the toner and the electrophotographic photosensitive member.

An example of the schematic construction of an electrophotographic apparatus including a process cartridge including an electrophotographic photosensitive member is illustrated in FIGURE.

A cylindrical electrophotographic photosensitive member 1 is rotationally driven about a shaft 2 in a direction indicated by the arrow at a predetermined peripheral speed. The surface of the electrophotographic photosensitive member 1 is charged to a predetermined positive or negative potential by a charging unit 3. In FIGURE, a roller charging system based on a roller-type charging member is illustrated, but a charging system such as a corona charging system, a proximity charging system, or an injection charging system may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system configured to remove the deposit with the developing unit 5 or the like without separate arrangement of the cleaning unit 9 may be used. The electrophotographic apparatus may include an electricity-removing mechanism configured to subject the surface of the electrophotographic photosensitive member 1 to electricity-removing treatment with pre-exposure light 10 from a pre-exposing unit (not shown). In addition, a guiding unit 12, such as a rail, may be arranged for removably mounting a process cartridge 11 according to at least one embodiment of the present invention onto the main body of an electrophotographic apparatus.

The electrophotographic photosensitive member according to at least one embodiment of the present invention may be used in, for example, a laser beam printer, an LED printer, and a copying machine.

EXAMPLES

The present invention is more specifically described by way of Examples described below. However, the present invention is by no means limited by the examples. A toner and a method of producing the toner are described below. All of the terms "part(s)" and "%" in Examples and in Comparative Examples are on a mass basis unless otherwise stated.

<Production Example of Toner Base Particle-Dispersed Liquid>

(Preparation of Aqueous Medium)

11.2 Parts of sodium phosphate (dodecahydrate) was loaded into a reaction vessel containing 390.0 parts of ion-exchanged water to prepare an aqueous solution of sodium phosphate. The temperature of the aqueous solution was held at 65° C. for 1.0 hour while the reaction vessel was purged with nitrogen. While the aqueous solution of sodium phosphate was stirred with a stirring apparatus (product name: T.K. Homomixer, manufactured by Tokushu Kika Kogyo Co., Ltd.) at 12,000 rpm, an aqueous solution of calcium chloride obtained by dissolving 7.4 parts of calcium chloride (dihydrate) in 10.0 parts of ion-exchanged water was collectively loaded into the reaction vessel to prepare an aqueous medium containing a dispersion stabilizer. Further, 1.0 mol/L hydrochloric acid was loaded into the aqueous medium in the reaction vessel to adjust its pH to 6.0. Thus, an aqueous medium was prepared.

(Preparation of Polymerizable Monomer Composition)

| | |
|---|---|
| Styrene | 60.0 parts |
| C.I. Pigment Blue 15:3 | 6.3 parts |

The materials were loaded into an attritor (manufactured by Nippon Coke & Engineering Co., Ltd.), and were dispersed with zirconia particles each having a diameter of 1.7 mm at 220 rpm for 5.0 hours to prepare a colorant-dispersed liquid having a pigment dispersed therein.

Next, the following materials were added to the colorant-dispersed liquid.

| | |
|---|---|
| Styrene | 10.0 parts |
| n-Butyl acrylate | 30.0 parts |
| Polyester resin (polycondensate of terephthalic acid and a propylene oxide 2-mol adduct of bisphenol A, weight-average molecular weight Mw = 10,000, acid value: 8.2 mgKOH/g) | 5.0 parts |
| Paraffin wax (product name: HNP-9, manufactured by Nippon Seiro Co., Ltd., melting point: 76° C.) | 6.0 parts |

The materials were kept at 65° C., and were uniformly dissolved and dispersed with a stirring apparatus at 500 rpm. Thus, a polymerizable monomer composition was prepared.

(Granulation Step)

While the temperature of the aqueous medium was kept at 70° C. and the number of revolutions of a stirring apparatus was kept at 12,000 rpm, the polymerizable monomer composition was loaded into the aqueous medium, and 8.0 parts of t-butyl peroxypivalate serving as a polymerization initiator was added to the mixture. The resultant was granulated as it was with the stirring apparatus for 10 minutes while the number of revolutions was maintained at 12,000 rpm.

(Polymerization Step)

The stirring apparatus was changed to a stirring machine including a propeller stirring blade, and the granulated product was held at 70° C. and polymerized for 5.0 hours while being stirred at 200 rpm. Further, a polymerization reaction was performed by increasing the temperature to 85° C. and heating the resultant at the temperature for 2.0 hours. Further, the residual monomer was removed by increasing the temperature to 98° C. and heating the resultant at the temperature for 3.0 hours. Ion-exchanged water was added to adjust the concentration of toner base particles in the resultant dispersion liquid to 30.0%. Thus, a toner base particle-dispersed liquid having dispersed therein the toner base particles was obtained.

The toner base particles had a number-average particle diameter (D1) of 6.2 μm and a weight-average particle diameter (D4) of 6.9 μm.

<Production Example of Organosilicon Compound Liquid>

| | |
|---|---|
| Ion-exchanged water | 70.0 parts |
| Methyltriethoxysilane | 30.0 parts |

The materials were weighed in a 200-milliliter beaker, and the pH of the mixture was adjusted to 3.5 with 10% hydrochloric acid. After that, the mixture was stirred for 1.0 hour while being heated to 60° C. in a water bath. Thus, an organosilicon compound liquid was produced.

<Production Example of Polyvalent Acid Metal Salt Fine Particles>

| | |
|---|---|
| Ion-exchanged water | 100.0 parts |
| Sodium phosphate (dodecahydrate) | 8.5 parts |

After the materials had been mixed, 60.0 parts (corresponding to 7.2 parts in terms of a zirconium lactate ammonium salt) of a zirconium lactate ammonium salt (product name: ZC-300, Matsumoto Fine Chemical Co., Ltd.) was added to the mixture while the mixture was stirred with a stirring apparatus (product name: T.K. Homomixer, manufactured by Tokushu Kika Kogyo Co., Ltd.) at room temperature and 10,000 rpm. 1.0 mol/L hydrochloric acid was added to the reaction liquid to adjust its pH to 7.0. The temperature of the reaction liquid was adjusted to 25° C., and a reaction was performed for 1 hour while the stirring of the liquid was maintained.

After that, the solid content of the resultant was removed by centrifugation. Subsequently, the ions of sodium and the like were removed by repeating the following step three times: the solid content was dispersed in ion-exchanged water again, and the solid content was removed by centrifugation. The residue was dispersed in ion-exchanged water again, and the resultant was dried by spray drying to provide fine particles of a zirconium phosphate compound having a number-average particle diameter of 124 nm.

<Production Example of Toner Particles>

<Toner Particles 1>

(Protrusion Formation Step)

The following samples were weighed in a reaction vessel, and were mixed with a propeller stirring blade to provide a mixed liquid.

| | |
|---|---|
| Toner base particle-dispersed liquid | 500.0 parts |
| Organosilicon compound liquid | 35.0 parts |

Next, the pH of the resultant mixed liquid was adjusted to 9.5 with a 1.0 mol/L aqueous solution of NaOH, and the temperature of the mixed liquid was set to 50° C. After that, the mixed liquid was held at the temperature for 1.0 hour while being stirred with a propeller stirring blade.

(Polyvalent Acid Metal Salt Adhesion Step)

| | |
|---|---|
| 44% Aqueous solution of titanium lactate (product name: TC-310, manufactured by Matsumoto Fine Chemical Co., Ltd.) | 3.2 parts (corresponding to 1.4 parts in terms of titanium lactate) |
| Organosilicon compound liquid | 10.0 parts |

Subsequently, the materials were mixed in a reaction vessel. After that, the pH of the resultant mixed liquid was adjusted to 9.5 with a 1.0 mol/L aqueous solution of NaOH, and the mixed liquid was held at the pH for 4.0 hours. After the temperature of the mixed liquid had been reduced to 25° C., the pH was adjusted to 1.5 with 1.0 mol/L hydrochloric acid, and the mixed liquid was stirred for 1.0 hour. After that, the mixed liquid was filtered while being washed with ion-exchanged water. The resultant powder was dried in a thermostat, and was then classified with an air classifier to provide toner particles 1. The toner particles 1 had a number-average particle diameter (D1) of 6.2 and a weight-average particle diameter (D4) of 6.9 The toner particles 1 were analyzed (TEM-EDX) and observed through use of a transmission electron microscope and energy-dispersive X-ray spectroscopy. As a result, protruded portions each containing an organosilicon polymer were observed on the surfaces of the toner particles, and it was confirmed that titanium was present on the surface of each of the protruded portions. The protrusion height H was 60 nm. In addition, the analysis of the toner particles 1 by time-of-flight secondary ion mass spectrometry (TOF-SIMS analysis) detected an ion derived from titanium phosphate.

The titanium phosphate compound is a product of a reaction between titanium lactate and a phosphate ion derived from sodium phosphate or calcium phosphate derived from the aqueous medium.

<Toner Particles 2>

(Polyvalent Acid Metal Salt Adhesion Step)

The following samples were weighed in a reaction vessel, and were mixed with a propeller stirring blade to provide a mixed liquid.

| | |
|---|---|
| Toner base particle-dispersed liquid | 500.0 parts |
| 44% Aqueous solution of titanium lactate (product name: TC-310, manufactured by Matsumoto Fine Chemical Co., Ltd.) | 3.2 parts (corresponding to 1.4 parts in terms of titanium lactate) |
| Organosilicon compound liquid | 10.0 parts |

Next, the pH of the resultant mixed liquid was adjusted to 9.5 with a 1.0 mol/L aqueous solution of NaOH, and the mixed liquid was held at the pH for 5.0 hours. After the temperature of the mixed liquid had been reduced to 25° C., the pH was adjusted to 1.5 with 1.0 mol/L hydrochloric acid, and the mixed liquid was stirred for 1.0 hour. After that, the mixed liquid was filtered while being washed with ion-exchanged water. The resultant powder was dried in a thermostat, and was then classified with an air classifier to provide toner particles 2. The toner particles 2 had a number-average particle diameter (D1) of 6.2 μm and a weight-average particle diameter (D4) of 6.9 The toner particles 2 were subjected to TEM-EDX observation. As a result, an organosilicon polymer was present on the surface of each of the toner particles, but no protruded portion was formed thereon. In addition, it was confirmed that titanium was present on the surface of each of the toner particles. Further, the TOF-SIMS analysis of the toner particles 2 detected an ion derived from titanium phosphate.

The titanium phosphate compound is a product of a reaction between titanium lactate and a phosphate ion derived from sodium phosphate or calcium phosphate derived from the aqueous medium.

<Toner Particles 3>

Toner particles 3 were obtained in the same manner as in the production example of the toner particles 2 except that in the production example of the toner particles 2, 11.7 parts (corresponding to 1.4 parts in terms of a zirconium lactate ammonium salt) of a zirconium lactate ammonium salt (product name: ZC-300, Matsumoto Fine Chemical Co., Ltd.) was added instead of 3.2 parts of the 44% aqueous solution of titanium lactate (product name: TC-310, manufactured by Matsumoto Fine Chemical Co., Ltd.). The toner particles 3 had a number-average particle diameter (D1) of 6.2 μm and a weight-average particle diameter (D4) of 6.9 The toner particles 3 were subjected to TEM-EDX observation. As a result, an organosilicon polymer was present on the surface of each of the toner particles, but no protruded portion was formed thereon. In addition, it was confirmed that zirconium was present on the surface of each of the toner particles. Further, the TOF-SIMS analysis of the toner particles 3 detected an ion derived from zirconium phosphate.

The zirconium phosphate compound is a product of a reaction between a zirconium lactate ammonium salt and a phosphate ion derived from sodium phosphate or calcium phosphate derived from the aqueous medium.

<Toner Particles 4>

The following samples were weighed in a reaction vessel, and were mixed with a propeller stirring blade.

Toner base particle-dispersed liquid 500.0 parts

Next, while the temperature of the liquid was held at 25° C., the pH thereof was adjusted to 1.5 with 1.0 mol/L hydrochloric acid, and the liquid was stirred for 1.0 hour. After that, the liquid was filtered while being washed with ion-exchanged water. The resultant powder was dried in a thermostat, and was then classified with an air classifier to provide toner particles 4.

<Toner Particles 5>

Toner particles 5 were obtained in the same manner as in the production example of the toner particles 2 except that in the production example of the toner particles 2, the 44% aqueous solution of titanium lactate (product name: TC-310, manufactured by Matsumoto Fine Chemical Co., Ltd.) was not added. The toner particles 5 had a number-average particle diameter (D1) of 6.2 μm and a weight-average particle diameter (D4) of 6.9 μm. The toner particles 5 were subjected to TEM-EDX observation. As a result, an organosilicon polymer was present on the surface of each of the toner particles, but no protruded portion was formed thereon. In addition, no metal element was present on the surface of each of the toner particles. Further, the TOF-SIMS analysis of the toner particles 5 detected no ion derived from the polyvalent acid metal salt.

<Method of Producing Toner>

<Toners 1, 2, 3, and 5>

The toner particles 1, 2, 3, and 5 were used as toners 1, 2, 3, and 5, respectively.

<Toner 4>

| | |
|---|---|
| Toner particles 4 | 100.0 parts |
| Hidrophobic silica fine particles (hexamethyldisilazane treatment: number-average particle diameter: 12 nm) | 1.0 part |
| Polyvalent acid metal salt fine particles | 2.0 parts |

The materials were loaded into SUPERMIXER PICCOLO SMP-2 (manufactured by Kawata Mfg. Co., Ltd.), and were mixed at 3,000 rpm for 20 minutes. After that, the mixture was sieved with a mesh having an aperture of 150 μm to provide a toner 4. The toner 4 had a number-average particle diameter (D1) of 6.2 μm and a weight-average particle diameter (D4) of 6.9 μm. The toner 4 was subjected to TEM-EDX observation. As a result, no organosilicon polymer was present on the surface of each of the toner particles. In addition, it was confirmed that zirconium was present on the surface of each of the toner particles. The TOF-SIMS analysis of the toner 4 detected an ion derived from zirconium phosphate.

The physical properties of the toners 1 to 5 are shown in Table 7.

<Method of Calculating Protrusion Height H>

The sections of toner particles are observed with a transmission electron microscope (TEM) by the following method.

First, the toner particles are sufficiently dispersed in a normal temperature-curable epoxy resin, and then the resultant is cured under an atmosphere at 40° C. for 2 days.

A flaky sample having a thickness of 50 nm is cut out of the resultant cured product with a microtome (product name: EM UC7, manufactured by Leica Microsystems) including a diamond blade.

The sample is magnified at a magnification of 500,000 with a TEM (product name: JEM-2800, manufactured by JEOL Ltd.) under the conditions of an acceleration voltage of 200 V and an electron beam probe size of 1 mm, and the sections of the toner particles are observed. At this time, sections each having a maximum diameter, which is from 0.9 to 1.1 times as large as the number-average particle diameter (D1) of the toner measured in accordance with a method of measuring the number-average particle diameter (D1) of toner particles to be described later, are selected as the sections of the toner particles. Subsequently, constituent elements for the resultant sections of the toner particles are analyzed by utilizing energy-dispersive X-ray spectroscopy (EDX), and an EDX mapping image (256×256 pixels (2.2 nm/pixel), number of scans: 200 times) is produced.

When a signal derived from a silicon element is observed on the surface of each of the toner base particles in the produced EDX mapping image, the signal is adopted as an image of an organosilicon polymer. In addition, when the image of the organosilicon polymer is continuously observed on the surface of each of the toner base particles, a line segment connecting the end points of the image of the organosilicon polymer is adopted as a base line. A portion in which the intensity of the signal derived from a silicon element is identical to the silicon intensity of a background is adopted as an end point of the image of the organosilicon polymer.

For each base line, a perpendicular having the maximum length out of perpendiculars from the base line to the surface of the image of the organosilicon polymer is sought, and the maximum length is adopted as a protrusion height. The sections of the 20 toner particles are analyzed in accordance with the above-mentioned method, and the average of the resultant protrusion heights is adopted as a protrusion height H (nm).

<Method of Calculating Ratios M1 and M2 of Metal Element M Through Use of X-Ray Photoelectron Spectroscopy>

•Treatment (a)

160 Grams of sucrose (manufactured by Kishida Chemical Co., Ltd.) is added to 100 mL of ion-exchanged water, and is dissolved therein while being warmed in hot water. Thus, a 61.5% aqueous solution of sucrose is prepared. 31.0 Grams of the concentrated aqueous solution of sucrose and 6 g of Contaminon N (product name) (10 mass % aqueous solution of a neutral detergent for washing a precision measuring unit, the detergent being formed of a nonionic surfactant, an anionic surfactant, and an organic builder, and having a pH of 7, manufactured by Wako Pure Chemical Industries, Ltd.) are loaded into a centrifugal tube to produce a dispersion liquid. 1.0 Gram of a toner is added to the dispersion liquid, and the lump of the toner is loosened with a spatula or the like. The centrifugal tube is shaken with a shaker at 300 strokes per minute (spm) for 20 minutes. After the shaking, the solution is transferred to a glass tube (50 mL) for a swing rotor, and is separated with a centrifugal separator under the conditions of 3,500 rpm and 30 minutes. It is visually confirmed that the toner and the aqueous solution are sufficiently separated from each other, and the toner separated in the uppermost layer is collected with a spatula or the like. The collected toner is filtered with a vacuum filter, and is then dried with a dryer for 1 hour or more. The dried product is shredded with a spatula to provide a toner (a).

The toner according to at least one embodiment of the present invention and the toner (a) are subjected to measurement by using X-ray photoelectron spectroscopy as described below, and the M1 and the M2 are calculated.

The ratio between the ratios M1 and M2 of the metal element M is calculated by subjecting the toners to measurement under the following conditions.

Measurement apparatus: X-ray photoelectron spectroscope: (product name: Quantum 2000, manufactured by ULVAC-PHI, Inc.)

X-ray source: monochromatic Al Kα

X-ray setting: 100 μmφ (25 W (15 KV))

Photoelectron extraction angle: 45°

Neutralization condition: combination of a neutralization gun and an ion gun

Analyzed area: 300×200 μm

Pass energy: 58.70 eV

Step size: 0.1.25 eV

Analysis software: Maltipak (ULVAC-PHI, Inc.)

Herein, in the calculation of the quantitative value of, for example, a Ti atom, the peak of Ti 2p (B.E.: from 452 eV to 468 eV) is used. The quantitative value of the Ti element obtained here is represented by M1 (atm %).

The toner according to at least one embodiment of the present invention and the toner (a) are subjected to measurement by using the above-mentioned method, and the ratios of the metal element M of the respective toners are represented by M1 (atm %) and M2 (atm %), respectively.

<Method of Detecting Polyvalent Acid Metal Salt>

The polyvalent acid metal salt on the surface of each of the toner particles is detected by the following method through use of time-of-flight secondary ion mass spectrometry (TOF-SIMS).

A toner sample is analyzed with a TOF-SIMS (product name: TRIFT IV, manufactured by ULVAC-PHI, Inc.) under the following conditions.

Primary ion species: gold ion ($Au^+$)

Primary ion current value: 2 pA

Analyzed area: 300×300 $\mu m^2$

Pixel count: 256×256 pixel

Analyzed time: 3 min

Repetition frequency: 8.2 kHz

Charge neutralization: ON

Secondary ion polarity: Positive

Secondary ion mass range: m/z of from 0.5 to 1,850

Sample substrate: indium

The analysis is performed under the conditions, and when a peak derived from a secondary ion containing a metal ion and a polyvalent acid ion (in the case of, for example, titanium phosphate, $TiPO_3$ (m/z: 127), $TiP_2O_5$ (m/z: 207), or the like) is detected, it is judged that the polyvalent acid metal salt is present on the surface of each of the toner particles.

TABLE 7

| | Polyvalent acid metal salt | Organosilicon polymer | Protruded portion | M1 (atm %) | M2/M1 |
|---|---|---|---|---|---|
| Toner 1 | Titanium phosphate compound | Present | Present | 3.3 | 0.99 |

TABLE 7-continued

| | Polyvalent acid metal salt | Organosilicon polymer | Protruded portion | M1 (atm %) | M2/M1 |
|---|---|---|---|---|---|
| Toner 2 | Titanium phosphate compound | Present | Absent | 2.7 | 0.99 |
| Toner 3 | Zirconium phosphate compound | Present | Absent | 2.7 | 0.99 |
| Toner 4 | Zirconium phosphate compound | Absent | Absent | 0.2 | 0.50 |
| Toner 5 | Absent | Present | Absent | — | — |

<Production of Electrophotographic Photosensitive Member>

(Electrophotographic Photosensitive Member Production Example 1)

An aluminum cylinder having a diameter of 24 mm and a length of 257.5 mm (JIS-A3003, aluminum alloy) was used as a support (conductive support).

(Formation of Conductive Layer)

Next, the following materials were prepared.

(Metal Oxide Particles 1)

Titanium oxide covered with niobium-doped titanium oxide produced by the following production method was used as metal oxide particles 1.

Titanium dioxide serving as a core may be produced by a known sulfuric acid method. That is, the core is obtained by: heating a solution containing titanium sulfate, titanyl sulfate, or the like to hydrolyze the contents, thereby producing a metatitanic acid slurry; and subjecting the metatitanic acid slurry to dehydration calcination.

Anatase-type titanium oxide particles having an average primary particle diameter of 200 nm were used as core particles. A titanium-niobium sulfuric acid solution containing 33.7 g of titanium in terms of $TiO_2$ and 2.9 g of niobium in terms of $Nb_2O_5$ was prepared. 100 Grams of the core particles were dispersed in pure water to provide 1 L of a suspension, and the suspension was warmed to 60° C. The titanium-niobium sulfuric acid solution and 10 mol/L sodium hydroxide were dropped over 3 hours so that the pH of the suspension became from 2 to 3. After the entire amount of the materials had been dropped, the pH was adjusted to a value near a neutral region, and an aggregating agent was added to the suspension to precipitate its solid content. The supernatant was removed, and was filtered and washed, followed by drying at 110° C. Thus, an intermediate containing 0.1 wt % of organic matter derived from the aggregating agent in terms of C was obtained. The intermediate was calcined in a nitrogen gas at 750° C. for 1 hour, and its temperature was reduced to 450° C. After that, the resultant was calcined in an oxygen gas for 1 hour to produce the metal oxide particles 1.

[Preparation of Coating Liquid for Conductive Layer]

(Coating Liquid 1 for Conductive Layer)

80 Parts of a phenol resin (monomer/oligomer of the phenol resin) (product name: PLYOPHEN J-325, manufactured by DIC Corporation, resin solid content: 60%, density after curing: 1.3 g/$cm^3$) serving as a binding material was dissolved in 60 parts of 1-methoxy-2-propanol serving as a solvent to provide a solution.

160 Parts of the metal oxide particles 1 were added to the solution, and the mixture was loaded as a dispersion medium into a vertical sand mill using 200 parts of glass beads having an average particle diameter of 1.0 mm, followed by the performance of a dispersion treatment under the conditions of a dispersion liquid temperature of 23±3° C. and a number of revolutions of 1,500 rpm (a peripheral speed of 5.5 m/s) for 2 hours. Thus, a dispersion liquid was obtained. The glass beads were removed from the dispersion liquid with a mesh. The dispersion liquid after the removal of the glass beads was filtered under pressure with PTFE filter paper (product name: PF060, manufactured by Advantec Toyo Kaisha, Ltd.). 0.015 Part of a silicone oil (product name: SH 28 PAINT ADDITIVE, manufactured by Dow Corning Toray Co., Ltd.) serving as a leveling agent and 15 parts of silicone resin particles (product name: TOSPEARL 120, manufactured by Momentive Performance Materials, average particle diameter: 2 μm) serving as a surface roughness-imparting agent were added to the dispersion liquid after the filtration under pressure, and the mixture was stirred to prepare a coating liquid 1 for a conductive layer.

The coating liquid for a conductive layer was applied onto the support by dip coating, and the applied liquid was heated for 30 minutes at 150° C. to form a conductive layer having a thickness of 25.0 μm.

(Formation of Undercoat Layer)

The following materials were prepared.

| | |
|---|---|
| Electron-transporting substance represented by the following formula (ET-1) | 4 parts |
| Blocked isocyanate (product name: DURANATE SBN-70D, manufactured by Asahi Kasei Chemicals Corporation) | 5.5 parts |
| Polyvinyl butyral resin (product name: S-LEC KS-5Z, manufactured by Sekisui Chemical Co., Ltd.) | 0.3 part |
| Zinc(II) hexanoate as catalyst (manufactured by Mitsuwa Chemicals Co., Ltd.) | 0.05 part |

The materials were dissolved in a mixed solvent containing 50 parts of tetrahydrofuran and 50 parts of 1-methoxy-2-propanol to prepare a coating liquid for an undercoat layer. The coating liquid for an undercoat layer was applied onto the conductive layer by dip coating, and the applied liquid was heated for 30 minutes at 170° C. to form an undercoat layer having a thickness of 0.7 μm.

(ET-1)

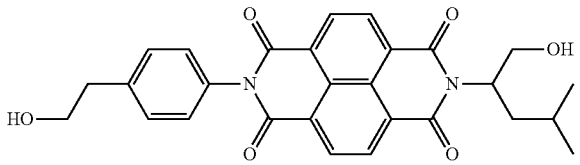

(Formation of Charge-Generating Layer)

Next, 10 parts of hydroxygallium phthalocyanine of a crystal form having peaks at positions of 7.5° and 28.4° in a chart obtained by CuKα characteristic X-ray diffraction, and 5 parts of a polyvinyl butyral resin (product name: S-LEC BX-1, manufactured by Sekisui Chemical Co., Ltd.) were prepared. The materials were added to 200 parts of cyclohexanone, and were dispersed therein with a sand mill apparatus using glass beads each having a diameter of 0.9 mm for 6 hours. 150 Parts of cyclohexanone and 350 parts of ethyl acetate were further added to the resultant to dilute the resultant. Thus, a coating liquid for a charge-generating layer was obtained. The resultant coating liquid was applied onto the undercoat layer by dip coating, and was dried at 95° C. for 10 minutes to form a charge-generating layer having a thickness of 0.20 μm. The X-ray diffraction measurement was performed under the following conditions.

[Powder X-Ray Diffraction Measurement]

Measurement apparatus used: manufactured by Rigaku Corporation, X-ray diffraction apparatus RINT-TTRII X-ray tube bulb: Cu Tube voltage: 50 KV Tube current: 300 mA Scan method: 2θ/θ scan Scan speed: 4.0°/min Sampling interval: 0.02°

Start angle (2θ): 5.0°

Stop angle (2θ): 40.0°

Attachment: standard sample holder

Filter: not used

Incident monochromator: used

Counter monochromator: not used

Divergent slit: open

Divergent longitudinal restriction slit: 10.00 mm

Scattering slit: open

Light-receiving slit: open

Flat-plate monochromator: used

Counter: scintillation counter (Formation of Charge-Transporting Layer)

Next, the following materials were prepared.

| | |
|---|---|
| A compound represented by the formula (CTM-1) (charge-transporting substance (hole-transportable compound)) | 9 parts |
| A compound represented by the formula (CTM-2) (charge-transporting substance (hole-transportable compound)) | 1 part |
| The resin (A-PC-1) shown as a resin including a siloxane segment in Table 8 | 1 part |

A resin having the structural unit represented by the formula (PC-7), the resin being shown as a resin free of any siloxane segment in Table 8 9 parts The materials were dissolved in a mixed solvent containing 25 parts of o-xylene, 15 parts of methyl benzoate, and 35 parts of dimethoxymethane to prepare a coating liquid for a charge-transporting layer.

(CTM-1)

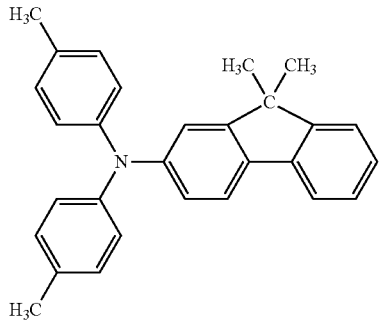

-continued (CTM-2)

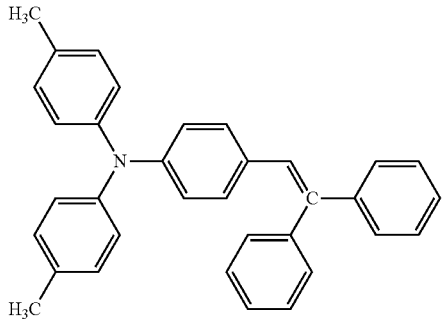

The coating liquid for a charge-transporting layer was applied onto the charge-generating layer by dip coating to form a coating film, and the coating film was dried for 30 minutes at 120° C. to form a charge-transporting layer having a thickness of 16 μm.

Thus, a cylindrical (drum-shaped) electrophotographic photosensitive member of Production Example 1 including the support, the undercoat layer, the charge-generating layer, and the charge-transporting layer in the stated order was produced.

| | Resin including siloxane segment | Content (mass %) | Structural unit of resin free of any siloxane segment | Mw |
|---|---|---|---|---|
| Production Example 1 | (A-PC-1) | 5 | (PC-7) | 120,000 |
| Production Example 2 | (A-PC-1) | 5 | (PC-1)/(PC-5)/(PC-8) = 5/2/3 | 130,000 |
| Production Example 3 | (A-PC-1) | 5 | (E-1)/(E-7) = 5/5 | 120,000 |
| Production Example 4 | (A-PC-1) | 5 | (E-13)/(E-18) = 7/3 | 100,000 |
| Production Example 5 | (A-PC-2) | 5 | (PC-7) | 120,000 |
| Production Example 6 | (A-PC-2) | 5 | (PC-1)/(PC-5)/(PC-8) = 5/2/3 | 130,000 |
| Production Example 7 | (A-PC-2) | 5 | (E-1)/(E-7) = 5/5 | 120,000 |
| Production Example 8 | (A-PC-2) | 5 | (E-13)/(E-18) = 7/3 | 100,000 |
| Production Example 9 | (A-PC-2) | 10 | (PC-7) | 120,000 |
| Production Example 10 | (A-PC-3) | 5 | (PC-7) | 120,000 |
| Production Example 11 | (A-PC-4) | 5 | (PC-7) | 120,000 |
| Production Example 12 | (A-PC-8) | 10 | (PC-7) | 120,000 |
| Production Example 13 | (A-PC-9) | 3 | (PC-7) | 120,000 |
| Production Example 14 | (A-PC-10) | 1 | (PC-7) | 120,000 |
| Production Example 15 | (A-PC-11) | 0.5 | (PC-7) | 120,000 |
| Production Example 16 | (B-PC-1) | 5 | (PC-7) | 120,000 |
| Production Example 17 | (B-PC-2) | 5 | (PC-7) | 120,000 |
| Production Example 18 | (B-PC-2) | 5 | (PC-7)/(PC-9) = 8/2 | 100,000 |
| Production Example 19 | (B-PC-2) | 5 | (E-14) | 90,000 |
| Production Example 20 | (B-PC-3) | 3 | (PC-7) | 120,000 |
| Production Example 21 | (B-PC-4) | 0.5 | (PC-7) | 120,000 |
| Production Example 22 | (B-PC-5) | 0.3 | (PC-7) | 120,000 |
| Production Example 23 | (B-PC-7) | 10 | (PC-7)/(PC-9) = 8/2 | 100,000 |
| Production Example 24 | (B-PC-10) | 5 | (PC-7)/(PC-9) = 8/2 | 100,000 |
| Production Example 25 | (C-PC-1) | 0.5 | (PC-7) | 120,000 |
| Production Example 26 | (C-PC-1) | 0.5 | (PC-7)/(PC-9) = 8/2 | 100,000 |
| Production Example 27 | (C-PC-2) | 0.2 | (PC-7) | 120,000 |
| Production Example 28 | (C-PC-2) | 0.2 | (PC-7)/(PC-9) = 8/2 | 100,000 |
| Production Example 29 | (C-PC-3) | 0.1 | (PC-7)/(PC-9) = 8/2 | 100,000 |
| Production Example 30 | (A-E-2) | 5 | (PC-7) | 120,000 |
| Production Example 31 | (A-E-2) | 5 | (E-1)/(E-7) = 5/5 | 120,000 |
| Production Example 32 | (A-E-5) | 5 | (E-14) | 90,000 |
| Production Example 33 | (B-E-2) | 5 | (PC-7) | 120,000 |
| Production Example 34 | (C-E-2) | 5 | (PC-7) | 120,000 |

In Table 8, the column "content" shows the content (mass %) of a resin including a siloxane segment with respect to the total mass of constituents in the surface layer of each electrophotographic photosensitive member, and the column "Mw" shows the weight-average molecular weights of resins each of which is free of any siloxane segment.

(Electrophotographic Photosensitive Member Production Examples 2 to 34)

Electrophotographic photosensitive members 2 to 34 were each produced in the same manner as in Production Example 1 except that in the production of the electrophotographic photosensitive member, the constructions of the resins to be incorporated into the surface layer were changed as shown in Table 8.

(Electrophotographic Photosensitive Member Production Example 35)

In the production of an electrophotographic photosensitive member 35, the process up to the formation of the charge-generating layer was performed in the same manner as in Electrophotographic Photosensitive Member Production Example 1.

The following materials were prepared as materials for a coating liquid for a charge-transporting layer.

| | |
|---|---|
| A compound represented by the formula (CTM-1) (charge-transporting substance (hole-transportable compound)) | 9 parts |
| A compound represented by the formula (CTM-2) (charge-transporting substance (hole-transportable compound)) | 1 part |
| A resin having the structural unit represented by the formula (PC-7) | 10 parts |

The materials were dissolved in a mixed solvent containing 25 parts of o-xylene, 15 parts of methyl benzoate, and 35 parts of dimethoxymethane to prepare a coating liquid for a charge-transporting layer.

The coating liquid for a charge-transporting layer was applied onto the charge-generating layer by dip coating to form a coating film, and the coating film was dried for 30 minutes at 120° C. to form a charge-transporting layer having a thickness of 16 μm.

Thus, a cylindrical (drum-shaped) electrophotographic photosensitive member of Production Example 35 including the support, the conductive layer, the undercoat layer, the charge-generating layer, and the charge-transporting layer in the stated order was produced.

Examples 1 to 34 and Comparative Examples 1 to 5

The following evaluation was performed by using the toners 1 to 5 and the electrophotographic photosensitive members of Production Examples 1 to 35 in accordance with combinations shown in Table 9. The evaluation results are shown in Table 9.

TABLE 9

| | Toner | Electrophotographic photosensitive member | Fogging density |
|---|---|---|---|
| Example 1 | Toner 1 | Production Example 1 | 0.22 |
| Example 2 | Toner 1 | Production Example 2 | 0.23 |
| Example 3 | Toner 1 | Production Example 3 | 0.25 |
| Example 4 | Toner 1 | Production Example 4 | 0.22 |
| Example 5 | Toner 2 | Production Example 5 | 0.23 |
| Example 6 | Toner 2 | Production Example 6 | 0.24 |
| Example 7 | Toner 2 | Production Example 7 | 0.25 |
| Example 8 | Toner 2 | Production Example 8 | 0.26 |
| Example 9 | Toner 3 | Production Example 9 | 0.38 |
| Example 10 | Toner 3 | Production Example 10 | 0.39 |
| Example 11 | Toner 3 | Production Example 11 | 0.37 |
| Example 12 | Toner 4 | Production Example 12 | 0.68 |
| Example 13 | Toner 4 | Production Example 13 | 0.7 |
| Example 14 | Toner 1 | Production Example 14 | 0.35 |
| Example 15 | Toner 1 | Production Example 15 | 0.34 |
| Example 16 | Toner 1 | Production Example 16 | 0.28 |
| Example 17 | Toner 1 | Production Example 17 | 0.3 |
| Example 18 | Toner 1 | Production Example 18 | 0.29 |
| Example 19 | Toner 1 | Production Example 19 | 0.31 |
| Example 20 | Toner 2 | Production Example 20 | 0.38 |
| Example 21 | Toner 3 | Production Example 21 | 0.58 |
| Example 22 | Toner 4 | Production Example 22 | 0.61 |
| Example 23 | Toner 2 | Production Example 23 | 0.42 |
| Example 24 | Toner 2 | Production Example 24 | 0.44 |
| Example 25 | Toner 1 | Production Example 25 | 0.32 |
| Example 26 | Toner 1 | Production Example 26 | 0.38 |
| Example 27 | Toner 1 | Production Example 27 | 0.39 |
| Example 28 | Toner 1 | Production Example 28 | 0.41 |
| Example 29 | Toner 1 | Production Example 29 | 0.79 |
| Example 30 | Toner 1 | Production Example 30 | 0.29 |
| Example 31 | Toner 1 | Production Example 31 | 0.31 |
| Example 32 | Toner 1 | Production Example 32 | 0.55 |
| Example 33 | Toner 1 | Production Example 33 | 0.49 |
| Example 34 | Toner 1 | Production Example 34 | 0.71 |
| Comparative Example 1 | Toner 5 | Production Example 1 | 1.55 |
| Comparative Example 2 | Toner 5 | Production Example 2 | 1.58 |
| Comparative Example 3 | Toner 5 | Production Example 17 | 1.6 |
| Comparative Example 4 | Toner 1 | Production Example 35 | 1.43 |
| Comparative Example 5 | Toner 5 | Production Example 35 | 1.88 |

An evaluation method and evaluation criteria according to at least one embodiment of the present invention are described.

A commercial laser printer (product name: LBP-712Ci, manufactured by Canon Inc.) was connected to an external high-voltage power source, and was reconstructed so that an arbitrary potential difference could be arranged between its charging blade and its charging roller, and its process speed was set to 200 mm/sec. The reconstructed machine obtained as described above and a commercial process cartridge were used as an image-forming apparatus. A product toner was removed from the inside of the cartridge, and the inside was cleaned with an air blow. After that, 165 g of the toner according to at least one embodiment of the present invention was loaded into the cartridge. The product toner was removed from each of yellow, magenta, and black stations, and yellow, magenta, and black cartridges in each of which a toner remaining amount-detecting mechanism was disabled were inserted into the respective stations before the evaluation was performed.

<Evaluation of Image Fogging>

HP Brochure Paper 200 g, Glossy (basis weight: 200 g/cm$^2$) of a letter size was used, and paper measuring 75 mm by 75 mm (POST-IT, 3M Japan Limited) was bonded to its central position, followed by the printing-out of a solid white image having a print percentage of 0% in a gloss paper mode (⅓ speed).

The bonded paper was removed from the printed-out image, and a fogging density (%) was calculated from a difference between the whiteness degree of the white ground portion of the printed-out image and the whiteness degree of the transfer paper measured with "REFLECTOMETER MODEL TC-6D5" (product name) (manufactured by Tokyo Denshoku Co., Ltd.), followed by the evaluation of image fogging. An amber filter was used as a filter.

According to at least one embodiment of the present invention, the process cartridge and the electrophotographic apparatus each of which is reduced in fogging for reducing a toner consumption can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-137131, filed Jul. 25, 2019, and Japanese Patent Application No. 2020-113418, filed Jun. 30, 2020, which are hereby incorporated by reference herein in their entirety.

What is claimed is:

1. A process cartridge removably mounted onto a main body of an electrophotographic apparatus, the process cartridge comprising:

an electrophotographic photosensitive member; and a developing unit containing a toner, the toner including a toner particle, and having a phosphoric acid metal salt on at least part of a surface of the toner particle, wherein the phosphoric acid metal salt includes at least one metal element belonging to Groups 3 to 13, and a surface layer of the electrophotographic photosensitive member contains a resin including a siloxane segment.

2. The process cartridge according to claim 1, wherein the resin including the siloxane segment is a polycarbonate resin or a polyester resin, and the siloxane segment is represented by formulae (A) or (B)

(A)

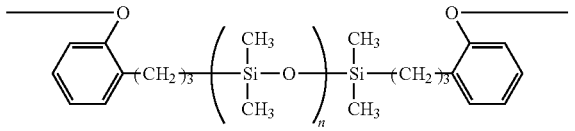

(B)

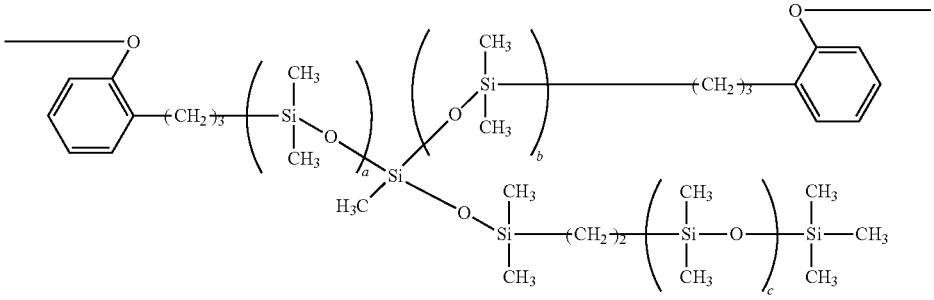

where n is 10-120, a and b are independently 1 to 10, and c is 20 to 200.

3. The process cartridge according to claim 1, wherein the resin including the siloxane segment is a polycarbonate resin or a polyester resin, and the siloxane segment is represented by formula (C)

(c)

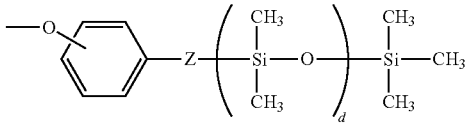

where d is 10 to 120, and Z represents an alkylene group having 3 or less carbon atoms.

4. The process cartridge according to claim 1, wherein a content of the resin including the siloxane segment is 0.1 to 10 mass % with respect to a total mass of constituents in the surface layer of the electrophotographic photosensitive member.

5. The process cartridge according to claim 1, wherein the metal element of the phosphoric acid metal salt is contained at a 1.0 to 10.0 (atm %) constituent element ratio of the surface of the toner particle as determined by X-ray photoelectron spectroscopy of the toner.

6. The process cartridge according to claim 1, wherein the phosphoric acid metal salt is a titanium phosphate compound.

7. The process cartridge according to claim 1, wherein the phosphoric acid metal salt is a zirconium phosphate compound.

8. An electrophotographic apparatus comprising a process cartridge, the process cartridge comprising:

an electrophotographic photosensitive member; and a developing unit containing a toner, the toner including a toner particle, and having a phosphoric acid metal salt on at least part of a surface of the toner particle, wherein the phosphoric acid metal salt includes at least one metal element belonging to Groups 3 to 13, and a surface layer of the electrophotographic photosensitive member contains a resin including a siloxane segment.

9. The electrophotographic apparatus according to claim 8, wherein the phosphoric acid metal salt is a titanium phosphate compound.

10. The electrophotographic apparatus according to claim 8, wherein the phosphoric acid metal salt is a zirconium phosphate compound.

* * * * *